US011319206B2

(12) United States Patent
Brummett et al.

(10) Patent No.: US 11,319,206 B2
(45) Date of Patent: May 3, 2022

(54) METHOD OF UPHOLSTERING TRUSS

(71) Applicant: L&P Property Management Company, South Gate, CA (US)

(72) Inventors: Travis L. Brummett, Carthage, MO (US); Daniel Meyer, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 9 days.

(21) Appl. No.: 17/147,083

(22) Filed: Jan. 12, 2021

(65) Prior Publication Data

US 2021/0130156 A1 May 6, 2021

Related U.S. Application Data

(60) Division of application No. 16/391,743, filed on Apr. 23, 2019, now Pat. No. 10,981,776, which is a continuation-in-part of application No. 16/129,132, filed on Sep. 12, 2018, now Pat. No. 10,793,302.

(51) Int. Cl.

| | |
|---|---|
| ***B68G 7/05*** | (2006.01) |
| ***B68G 7/12*** | (2006.01) |
| ***B68G 15/00*** | (2006.01) |
| ***A47C 31/02*** | (2006.01) |
| ***B68G 7/052*** | (2006.01) |

(52) U.S. Cl.

CPC ..... *B68G 7/052* (2013.01); *A47C 31/023* (2013.01); *A47C 31/026* (2013.01); *B68G 7/12* (2013.01); *B68G 15/005* (2013.01)

(58) Field of Classification Search

CPC ..... B68G 7/052; B68G 7/12; B68G 15/005; A47C 31/023; A47C 31/026; A47C 19/021

See application file for complete search history.

(56) References Cited

U.S. PATENT DOCUMENTS 3,371,466 A * 3/1968 Klopfenstein ..... B65B 11/12 53/371.9
3,840,167 A * 10/1974 Otteman ..... B27F 7/00 227/76
4,461,136 A * 7/1984 Hudson ..... B65B 11/04 53/399

(Continued)

FOREIGN PATENT DOCUMENTS

WO WO-2020055570 A1 * 3/2020 ..... A47C 19/021

OTHER PUBLICATIONS

United States Patent and Trademark Office; Search Report and Written Opinion in related International Patent Application No. PCT/US19/47808 dated Nov. 14, 2019; 10 pages.

*Primary Examiner* — Bayan Salone

(74) *Attorney, Agent, or Firm* — Wood Herron & Evans LLP

(57) ABSTRACT

An apparatus for upholstering a truss allows an operator to staple a fabric web to the truss, rotate the truss, further staple the semi-finished truss and cut the fabric web. The truss is fully upholstered after the end surfaces of the truss are wrapped up in fabric and the fabric stapled in place. The apparatus may accommodate different size trusses. A web of fabric is pulled around at least one roller in the apparatus by rotation of two vise mechanisms on opposite sides of the truss.

20 Claims, 32 Drawing Sheets

(56) References Cited

U.S. PATENT DOCUMENTS 4,832,152 A * 5/1989 Schuelke ..... A47B 83/001 181/290
5,129,569 A * 7/1992 Stanton ..... B68G 7/05 227/39
5,258,083 A * 11/1993 Monk ..... E04C 2/296 156/212
5,878,470 A * 3/1999 Blansett ..... A47C 4/028 160/381
6,032,345 A * 3/2000 Resta ..... B68G 15/005 29/91.2
7,395,590 B2 * 7/2008 Johnson ..... A47C 7/28 29/91
7,789,986 B2 * 9/2010 Brown ..... B68G 7/05 156/216
8,205,311 B2 * 6/2012 Woellper ..... B68G 7/12 29/243.57
8,453,306 B2 * 6/2013 Mazza ..... B68G 7/05 29/91.5
8,990,979 B1 * 3/2015 Craver ..... A47C 19/005 5/400
10,239,111 B2 * 3/2019 Knewtson ..... B21C 51/00
10,414,525 B2 9/2019 Zoboli
10,525,557 B2 * 1/2020 Subhedar ..... B68G 7/00
10,793,302 B2 * 10/2020 Brunnert ..... A47C 31/023
10,981,776 B2 * 4/2021 Brummett ..... A47C 19/021
11,174,049 B2 * 11/2021 Brunnert ..... A47C 19/021
2002/0046452 A1 * 4/2002 Kinney ..... B68G 7/05 29/91.5
2007/0214625 A1 * 9/2007 Brown ..... B68G 7/05 29/91.1
2010/0011553 A1 * 1/2010 Mazza ..... B68G 7/05 29/91
2010/0293771 A1 * 11/2010 Woellper ..... B68G 7/12 29/91.5
2014/0251193 A1 * 9/2014 Resta ..... D05B 39/00 112/475.08
2016/0200470 A1 7/2016 Zoboli et al.
2016/0214219 A1 * 7/2016 Subhedar ..... A47C 27/15
2017/0105538 A1 * 4/2017 Graham ..... A47C 21/00
2017/0136730 A1 * 5/2017 Dawson ..... A47L 23/266
2020/0377243 A1 * 12/2020 Brunnert ..... F16B 12/14

* cited by examiner

METHOD OF UPHOLSTERING TRUSS

CROSS REFERENCE TO RELATED APPLICATIONS

This application in a Divisional of U.S. patent application Ser. No. 16/391,743 filed Apr. 23, 2019 (pending), which is a Continuation-In-Part of U.S. patent application Ser. No. 16/129,132 filed Sep. 12, 2018 (now U.S. Pat. No. 10,793, 302) which are fully incorporated by reference herein.

TECHNICAL FIELD OF THE INVENTION

The present invention relates generally to trusses for use in bedding products such as ready to assemble ("RTA") bedding foundations.

BACKGROUND OF THE INVENTION

Bedding and seating products often have a rectangular wooden frame comprising four or more pieces. Two of the pieces are side pieces, one is a head end piece and the last piece is a foot end piece. In some bedding foundations, the wooden pieces of the frame are oriented with the larger of their width and height dimensions facing up and down. In other bedding and seating products the frame pieces are oriented "on edge" with the lesser of their width and height dimensions facing up and down. Securing a wooden side rail oriented "on edge" to a wooden head or foot rail oriented "on edge" is difficult due to the orientation of the rails. Different types of connectors secure the trusses together.

In today's world of e-commerce, bedding foundations have been made to fit and ship in a box. These bedding foundations are specially designed to be easily assembled by a consumer when they arrive at the customer's residence. These bedding foundations are known as ready to assemble ("RTA") bedding foundations or otherwise referred to as bed-in-a-box in the bedding industry. In order to reduce the weight of the bedding foundation wooden trusses, rather than solid wooden pieces, have been incorporated into the foundation. To improve the appearance of the foundation, the wooden trusses have been covered in fabric.

Before the present invention, an operator had to manually wrap a wooden truss in fabric, cut the fabric to the desired size and secure the fabric to the wooden truss.

Accordingly, there is a need for an apparatus for wrapping a wooden truss in fabric.

SUMMARY OF THE INVENTION

According to an exemplary embodiment, an apparatus for upholstering a truss for a bedding foundation with fabric comprises opposed sides and braces extending between the opposed sides. A front brace, a lower rear brace and an upper rear brace each extend between the opposed sides for stability. The apparatus further comprises a first vise mechanism secured to one side of the apparatus and a second vise mechanism secured to another side of the apparatus for gripping and rotating the truss. At least one of the vise mechanisms is movable to pinch the truss between the vise mechanisms so the vise mechanisms may rotate the truss. The apparatus further comprises a truss holder movable between raised and lowered positions by pneumatically controlled cylinders secured to the front brace. The apparatus further comprises a rotatable tension roller surrounding a shaft. The shaft extends between bearing assemblies attached to the sides of the apparatus. A spring-loaded brake assembly is secured to the shaft at one end of the rotatable tension roller to regulate or control the rotation of the tension roller as fabric moves through the apparatus.

According to another aspect of the invention, an apparatus for upholstering a truss for a bedding foundation with fabric comprises sides and at least one braces extending between the sides. Although the illustrated apparatus shows three braces extending between the sides for stability, the apparatus may have any number of braces extending between the sides for stability including a single brace. The apparatus further comprises a first vise mechanism secured to one side of the apparatus for gripping and rotating one side of the truss. The apparatus further comprises a second vise mechanism secured to another side of the apparatus for gripping and rotating another side of the truss. The apparatus further comprises a truss holder movable between raised and lowered positions by pneumatically controlled cylinders secured to a front brace. At least one of the vise mechanisms is movable to pinch the truss between the vise mechanisms so the vise mechanisms may rotate the truss with the truss holder in its lowered position. The apparatus further comprises a rotatable tension roller surrounding a shaft. The shaft extends between bearing assemblies attached to the sides of the apparatus. A spring-loaded brake assembly is secured to the shaft at one end of the rotatable tension roller to regulate or control the rotation of the tension roller as fabric moves through the apparatus.

According to another aspect of the invention, a method of wrapping fabric around a truss for a bedding foundation comprises the following steps. The first step is providing a roll of fabric supported by a fabric support. The steps further include providing a wrapping apparatus comprising two sides and braces extending between the sides, a truss holder movable between raised and lowered positions by pneumatically controlled cylinders secured to a front brace, a first vise mechanism secured to one side of the apparatus, a second vise mechanism secured to another side of the apparatus and a rotatable tension roller surrounding a shaft. The shaft extends between bearing assemblies attached to the sides of the apparatus. The method further comprises passing fabric from the roll of fabric through the wrapping apparatus. Another step comprises activating one of the vise mechanisms to move the vise mechanism in a linear direction towards the other vise mechanism to pinch the truss between the vise mechanisms. Another step comprises stapling the fabric to an upper surface of the truss. Another step comprises moving the truss holder to its lowered position and rotating the truss with the vise mechanisms. After the truss is fully wrapped, the method includes further stapling the fabric to the truss; and cutting the fabric to create a wrapped truss.

In one embodiment of the invention, the apparatus includes a linear actuator extending between and secured to the sides of the apparatus. The linear actuator may be activated by a servo motor or any motor known in the industry. A moveable carriage is secured to the linear actuator and moves from side-to-side across the apparatus above a wrapped truss. A stapler is secured to the movable carriage for stapling fabric to the wrapped truss. The stapler has a magazine to hold multiple staples. The operation of the stapler is controlled by the programmable logic controller. A cutter including a rotatable blade is also secured to the moveable carriage to cut the fabric as the carriage moves over the top of the wrapped and stapled truss. The blade rotates via a second servo motor secured to the moveable carriage. In place any servo motor used in the apparatus, any motor known in the industry may be used.

In using the embodiment of apparatus having the moveable carriage, an operator only needs to initially staple the fabric from the roll of fabric to an upper surface of the truss. After the apparatus turns the truss one full rotation such that all sides of the truss are covered with fabric, the linear actuator is activated causing the movable carriage to move across the wrapped truss above the wrapped truss. The stapler of the movable carriage is programmed to staple at a first staple position, last staple position and evenly spaced positions therebetween. After the moveable carriage reaches an end of the wrapped truss, a rotatable blade on the moveable carriage powered by a servo motor attached to the moveable carriage begins to rotate. The moveable carriage reverses direction and travels back across the top of the fully stapled and wrapped truss in a second direction opposite the first direction the carriage travelled while stapling. The rotating blade cuts the fabric as it travels such that the fabric separates from the continuous web of fabric. The result is a finished truss which an operator may manually remove from the truss holder before inserting an unwrapped truss onto the truss holder.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The drawings, which are incorporated in and constitute a part of this specification, illustrate embodiments of the invention and, together with the general description given above and the detailed description given below, explain the embodiments of the invention.

DETAILED DESCRIPTION OF THE INVENTION

Figure 1:
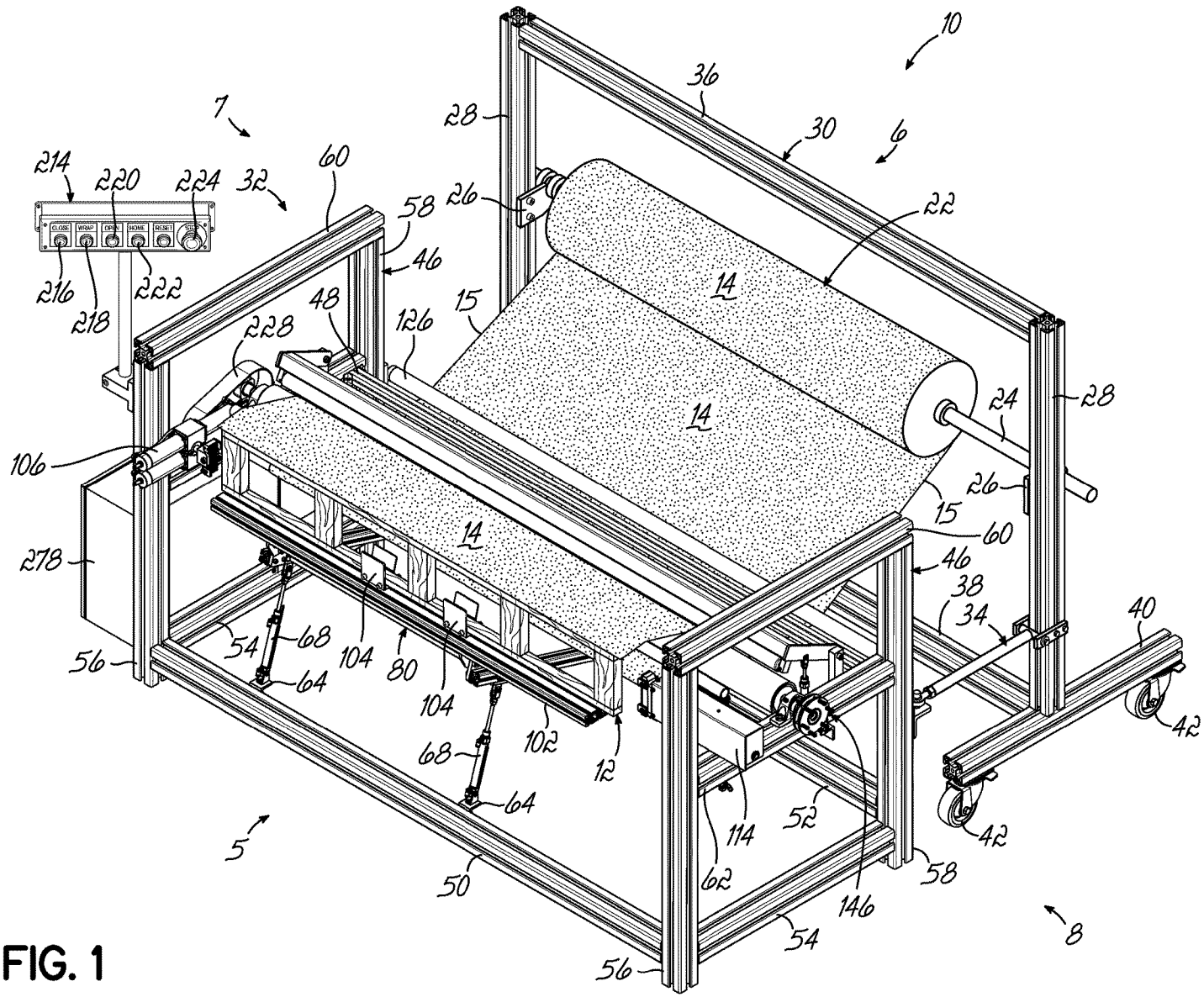
FIG. 1 is a perspective view of an apparatus for upholstering a truss for a bedding foundation with fabric.
Figures 2, 2A:
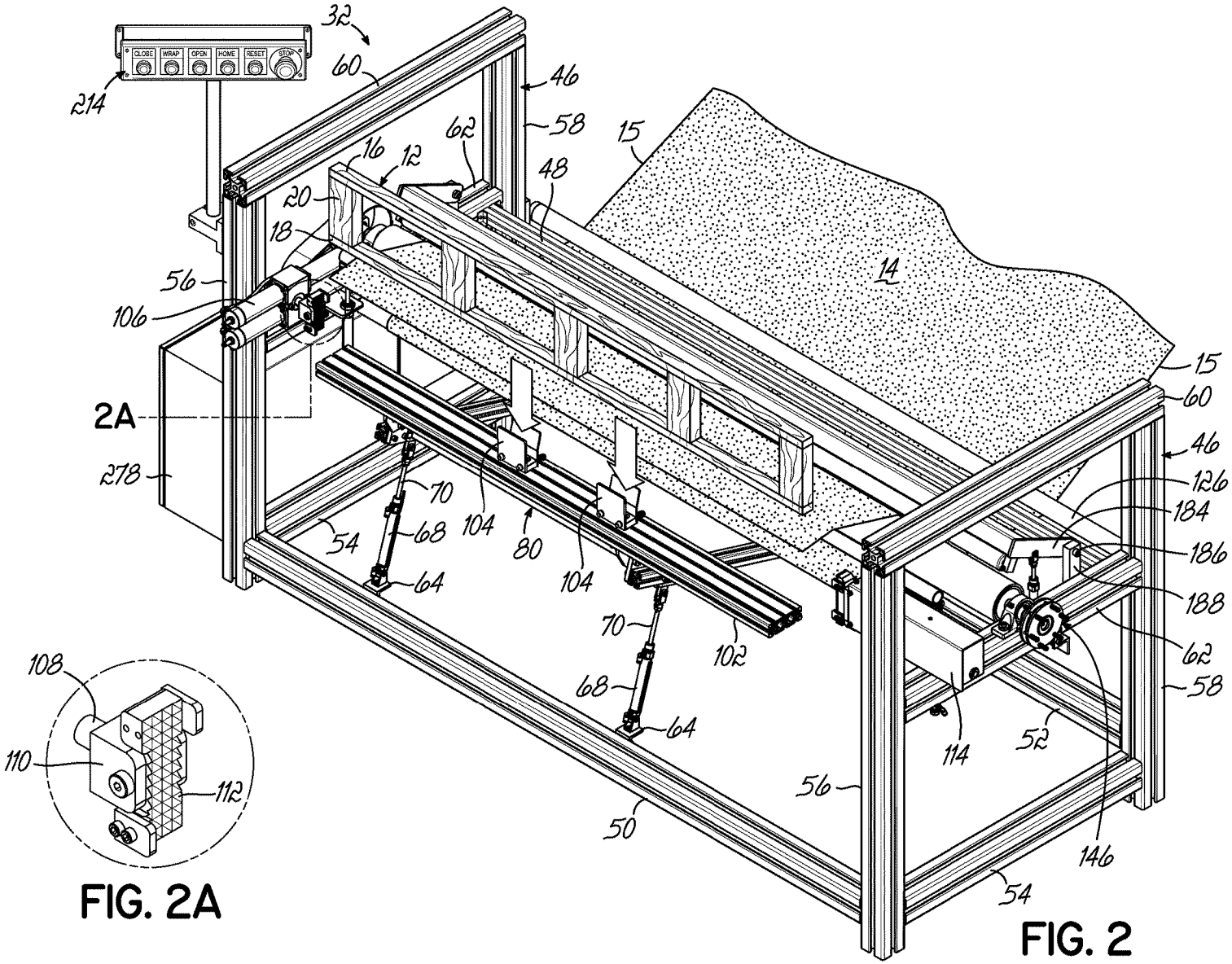
FIG. 2 is a perspective view of the apparatus of FIG. 1, showing a truss being inserted into the truss holder of the apparatus, the truss holder being in its raised position.
FIG. 2A is an enlarged perspective view of the encircled area 2A of FIG. 2.

Referring now to FIG. 1, an apparatus 10 for upholstering a truss 12 for a bedding foundation (not shown) with fabric is shown. As best shown in FIG. 2, the truss 12 comprises an upper member 16, a lower member 18 and a plurality of spacers 20 secured to the upper and lower members 16, 18. Various components of the truss 12 are typically constructed of wood, but may be plastic and/or metal. It will be appreciated that the components of the truss 12 may be constructed of any suitable material.

As best shown in FIG. 1, a fabric web 14 having side edges 15, the linear distance between which defines a width "W" of the fabric web. The fabric web 14 is supplied from a roll 22 of fabric supported from a bar 24 extending across brackets 26 secured to side members 28 of a fabric support 30. The fabric support 30 may be considered part of the apparatus 10, but is removably attached to the main portion 32 of the apparatus 10 with two aligners 34 (only one being shown). The aligners 34 align the fabric support 30 with the main portion 32 of the apparatus 10. FIG. 2 shows only the main portion 32 of the apparatus 10. Referring to FIG. 1, the fabric support 30 further comprises a top member 36 extending between upper ends of the side members 28 of the fabric support 30 and a bottom member 38 extending between lower ends of the side members 28 of the fabric support 30. The fabric support 30 further comprises two horizontally oriented legs 40 (only one being shown). As shown in FIG. 1, two caster wheels 42 are secured to each leg 40 of the fabric support 30 to facilitate movement of the fabric support 30.

Although one configuration of fabric support 30 is shown supporting one roll 32 of fabric, the fabric cart may be any other configuration and may support more than one roll of fabric.

For purposes of this document, the apparatus 10 is oriented in FIG. 1 so that the front of the apparatus is indicated by number 5, the rear by number 6, the left side by number 7 and the right side by number 8.

The main portion 32 of the apparatus 10 comprises two opposed generally rectangular sides 46, a front brace 50, a lower rear brace 52 and an upper rear brace 48, each of the braces 50, 52 and 48 extending between the generally rectangular sides 46. and two side base members 54, each side base member 54 extending between the front and rear base members 50, 52, respectively.

As best seen in FIG. 2, each side 46 comprises a vertically oriented front side member 56, a vertically oriented rear side member 58, a horizontally oriented top side member 60, a horizontally oriented middle side member 62 and a horizontally oriented bottom side member 54. The top, middle and bottom side members 60, 62 and 54, respectively, each extend between the front and rear side members 56, 58 on each of the sides 46.

Figure 2B:
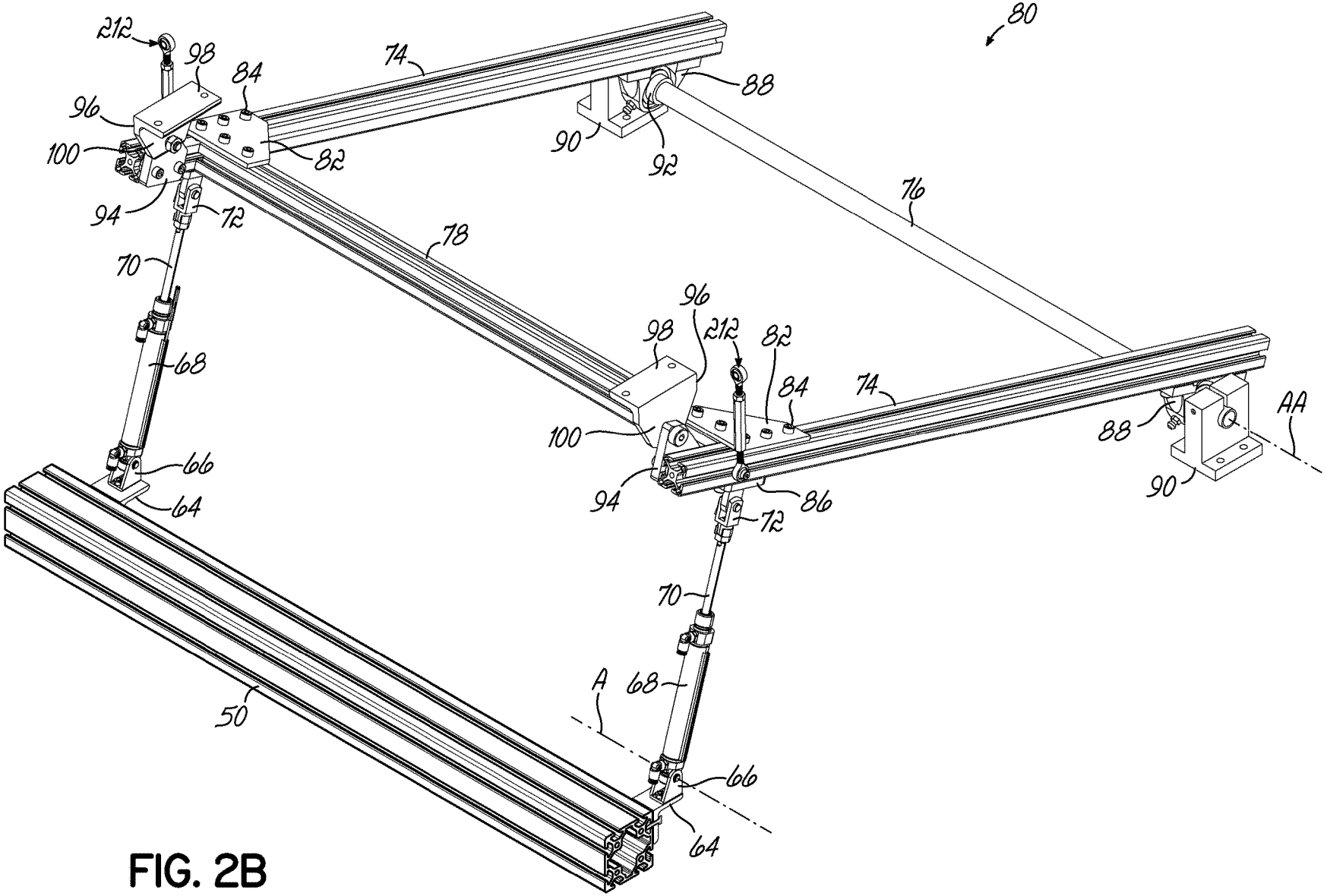
FIG. 2B is a perspective view of the lift assembly of the apparatus of FIG. 1.
Figure 6:
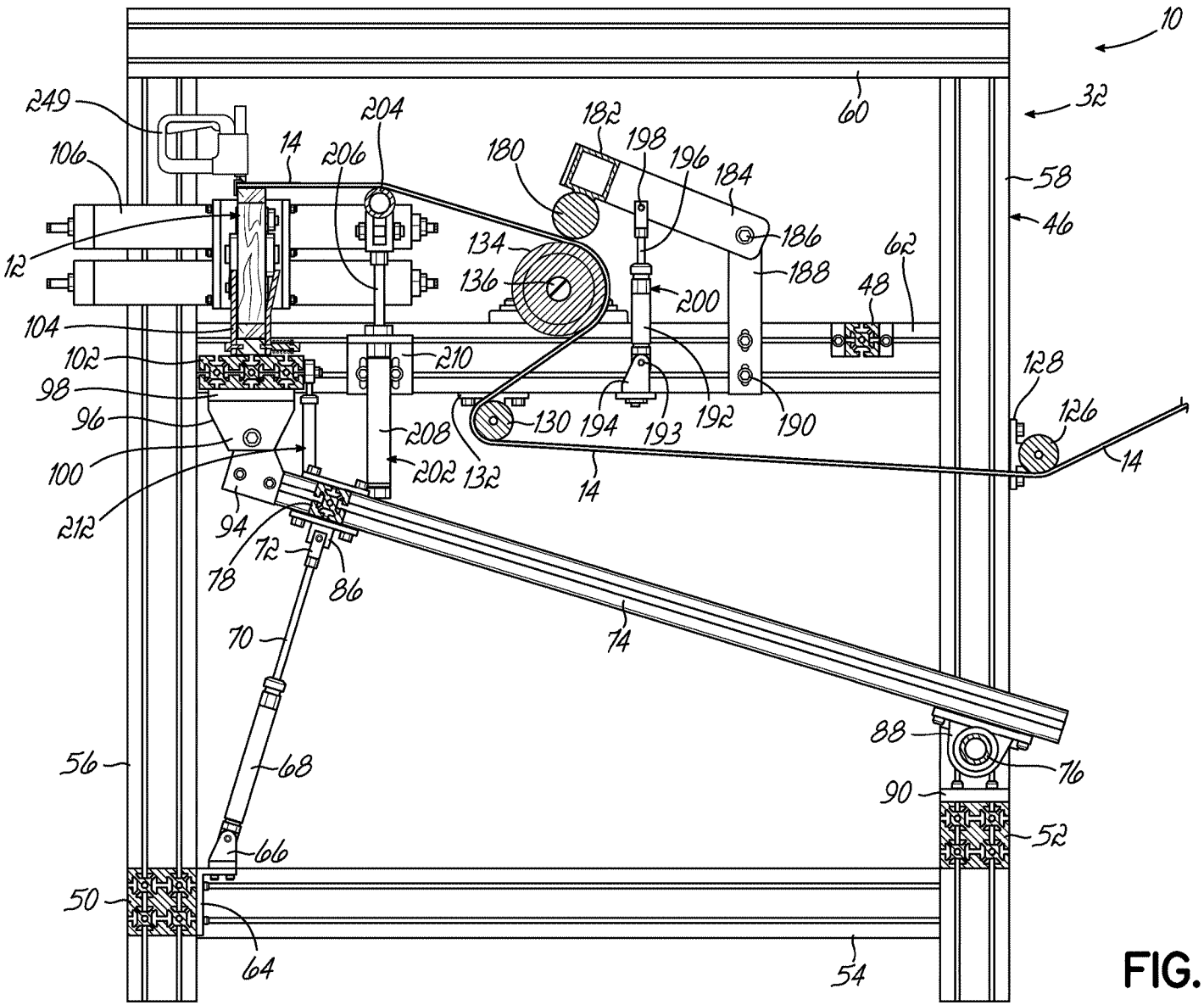
FIG. 6 is a cross sectional view of the apparatus of FIG. 1, showing the truss holder in its raised position supporting a truss.

As best illustrated in FIGS. 2B and 6, the main portion 32 of the apparatus 10 further comprises a lift assembly 80 comprising two lift arms 74 and a cross member 78 extending between the lift arms 74. A corner brace 82 is located at the intersection of each lift arm 74 and the cross member 78 for stability purposes and secured to one of the lift arms 74 and the cross member 78 with fasteners 84.

The lift assembly 80 further comprises two L-shaped mounting brackets 64 secured to the front base member 50. A generally U-shaped bracket 66 is secured to each of the L-shaped mounting brackets 64. As best illustrated in FIG. 6, a pneumatic cylinder 68 is pivotally secured to each of the generally U-shaped brackets 66 to pivot about axis A. A piston 70 extends into and out of each pneumatic cylinder 68 and is secured at its upper end to a U-shaped bracket 72, as shown in FIGS. 2B and 6. As best illustrated in FIG. 2B, the U-shaped bracket 72 is secured to a mount 86 which is secured to one of the lift arms 74.

The lift assembly 80 further comprises two bearing mounts 88, each bearing mount 88 being secured to a rear portion of one of the lift arms 74 and further secured to a base 90. Each bearing mount 88 has a bearing 92 therein. An assembly bar 76 extends through each of the bearings 92 and through each of the bases 90 such that the lift assembly 80 pivots about a horizontal pivot axis AA located through the center of the hollow assembly bar 76.

As shown in FIG. 2B, each lift arm 74 of lift assembly 80 has a front bracket 94 secured to a front portion of the lift arm 74. A support bracket 96 having an upper portion 98 and a lower portion 100 is pivotally secured to each front bracket 94.

As best shown in FIGS. 2 and 6, a truss holder 102 is secured to the upper portions 98 of the support brackets 96. Two spring biased clamps 104 are secured to the truss holder 102 for holding the truss 12, as shown in FIG. 1. Although two spring biased clamps 104 are shown in the drawings, any number of spring biased clamps may be used.

Figure 3A:
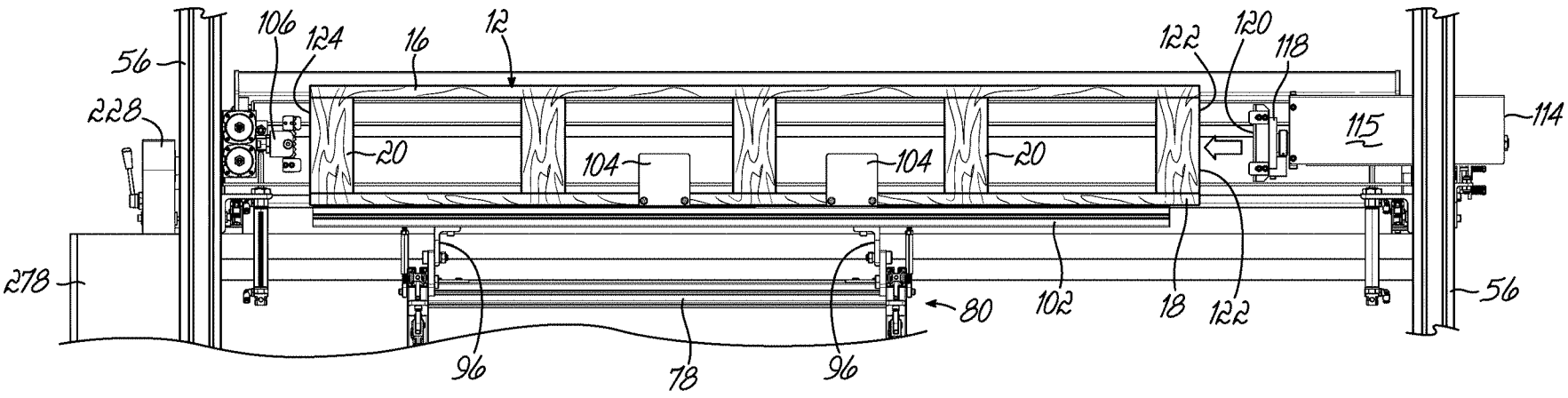
FIG. 3A is a front elevational view of a truss resting upon the truss holder before the vise mechanisms clamp or pinch the truss therebetween.
Figure 3B:
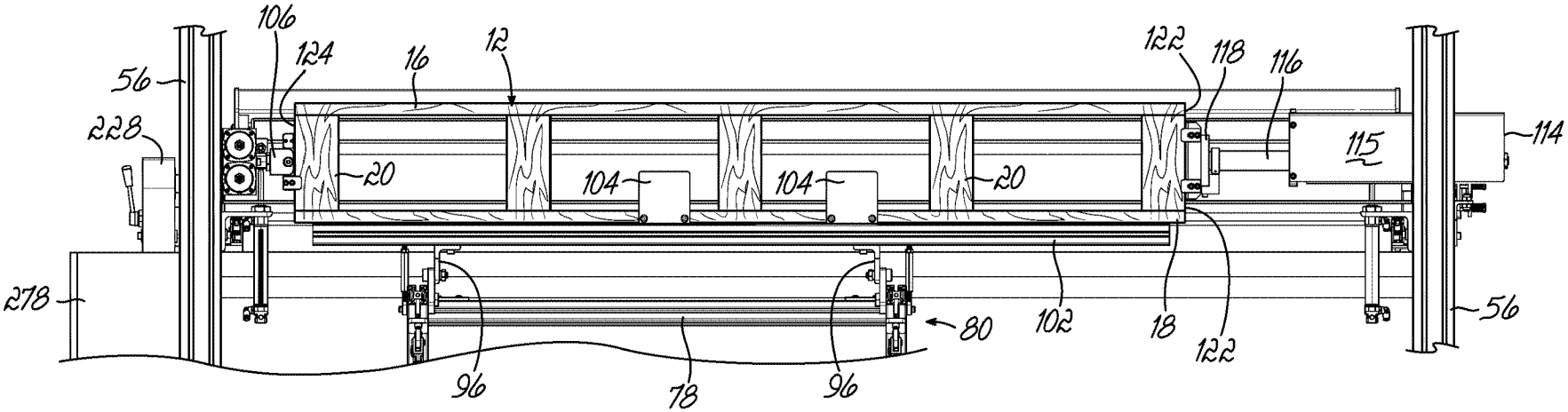
FIG. 3B is a front elevational view of a truss resting upon the truss holder, the vise mechanisms clamping or pinching the truss therebetween.

The apparatus 10 further comprises a first or left vise mechanism 106 for rotating the left side of a truss 12. One type of first or left vise mechanism is available from Bimba® Manufacturing under the trademark Pneu-Turn® at the website https://www.bimba.com/Products-and-Cad/Actuators/Inch/Rotary/Rack--Pinion/Pneu-Turn. The left vise mechanism 106 does not move linearly, but instead, only rotates. As seen in FIG. 2A, the left vise mechanism 106 comprises a rotatable shaft 108 terminating in a holder 110 which secures a jaw 112 therein. The jaw may be interchangeable so provide different types of surfaces to contact the truss 12. FIG. 3A shows the jaw 112 of the left vise mechanism 106 slightly spaced from the left end surface 124 of the truss 12. FIG. 3B shows the jaw 112 of the left vise mechanism 106 contacting the left end surface 124 of the truss 12.

The apparatus 10 further comprises a second or right vise mechanism 114 for rotating the right side of a truss 12. One type of second or right vise mechanism is available from Bimba® Manufacturing under the name Triple Rod at the website https://www.bimba.com/Products-and-Cad/Actuators/Inch/NFPA/Tie-Rod/TRA-Series-Triple-Rod. As shown in FIGS. 3A and 3B, the right vise mechanism 114 moves a rotatable shaft 116 terminating in a holder 118 linearly. The holder 118 secures a jaw 120 therein. The jaw 120 may be interchangeable so provide different types of surfaces to contact the truss 12. FIG. 3A shows the jaw 120 spaced from the right end surface 122 of the truss 12, the rotatable shaft 116 of the right vise mechanism 114 being in a closed position mostly inside a housing 115. FIG. 3B shows the jaw 120 contacting the right end surface 122 of the truss 12, the rotatable shaft 116 of the right vise mechanism 114 being in an expanded position.

As best shown in FIG. 6, the main portion 32 of apparatus 10 further comprises an outer idle roller 126 suspended by two outer brackets 128. Each outer bracket 128 is secured to the vertically oriented rear side member 58 of one of the sides 46. FIG. 6 only shows one outer bracket 128.

As best shown in FIG. 6, the main portion 32 of apparatus 10 further comprises a low idle roller 130 suspended by two suspension brackets 132. Each suspension bracket 132 is secured to one of the horizontally oriented middle side members 62 of one of the sides 46. FIG. 6 only shows one suspension bracket 132.

Figure 8:
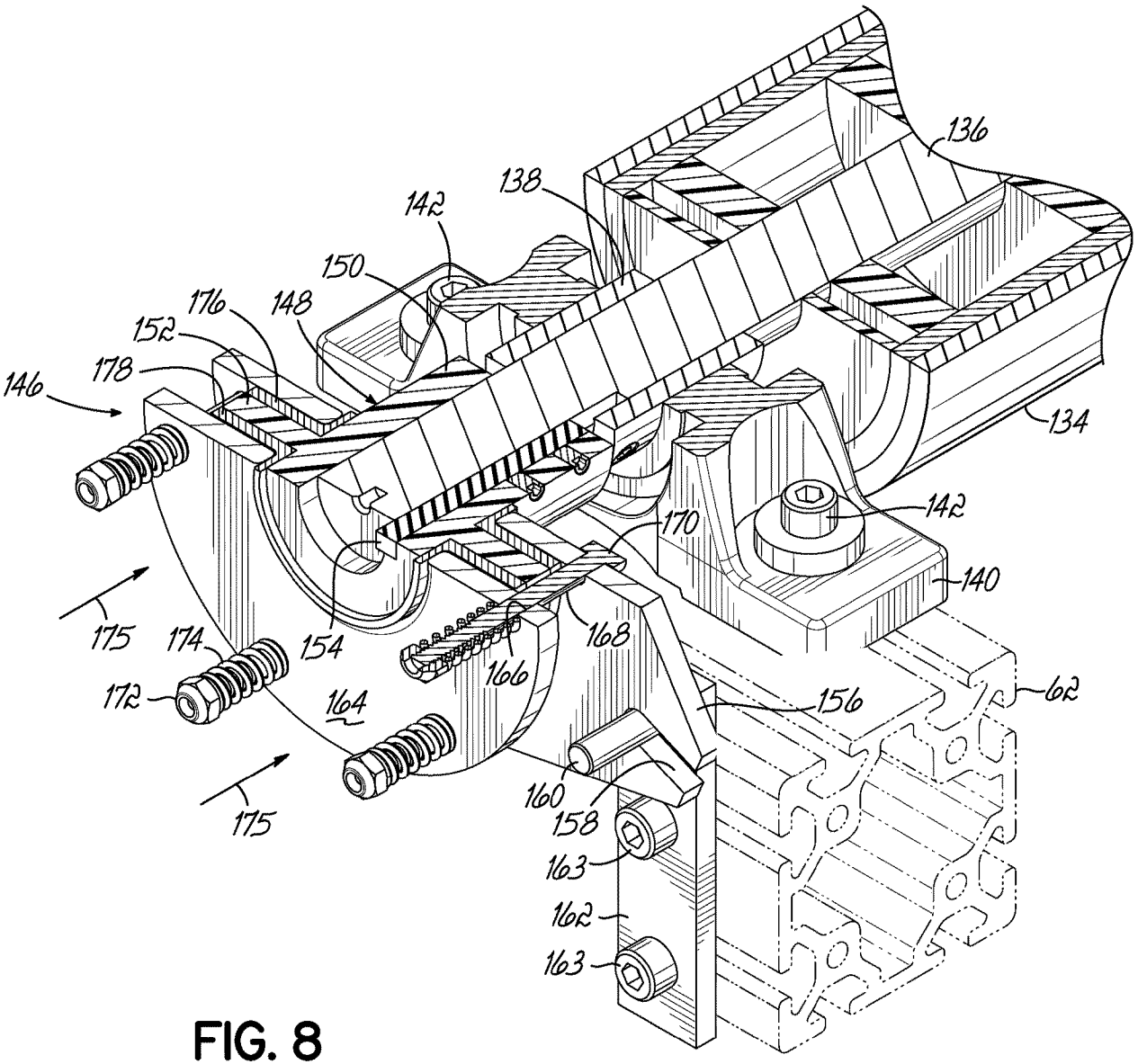
FIG. 8 is a cross sectional view illustrating the brake mechanism of the apparatus.
Figure 9:
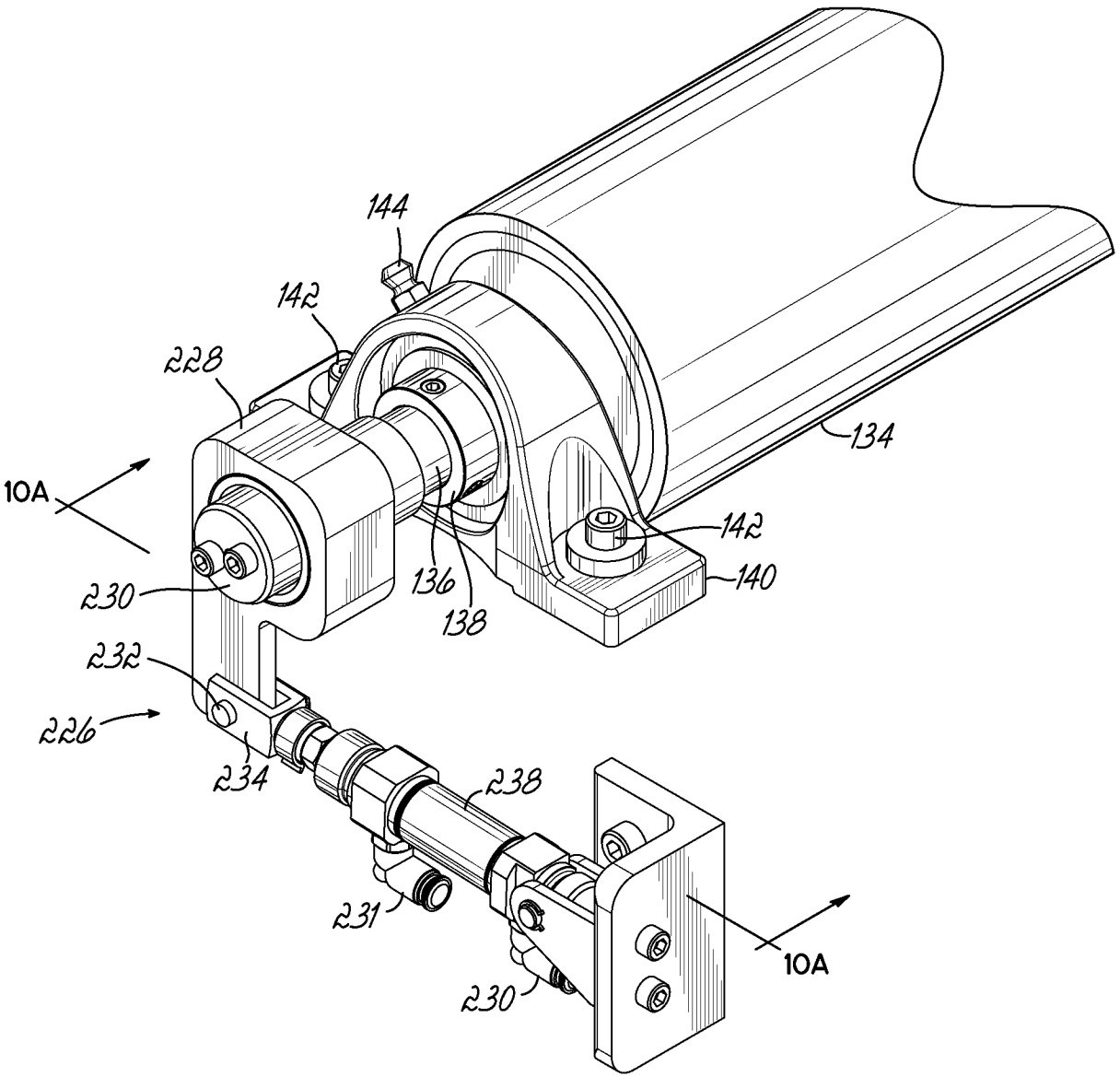
FIG. 9 is a perspective view of the ratcheting mechanism of the apparatus.

As best shown in FIGS. 6 and 8, the main portion 32 of apparatus 10 further comprises a rotatable tension roller 134 surrounding a shaft 136. The rotatable shaft 136 extends through a bearing 138 which is suspended inside a bearing housing 140 (only one being shown in FIG. 8). The bearing housing 140 at each end of shaft 136 is secured an upper surface of one of the horizontally oriented middle side members 62 of one of the sides 46 with fasteners 142, best shown in FIG. 8. FIG. 9 shows a grease fitting 144 for introducing grease into bearing 138.

As best shown in FIG. 8, a spring-loaded brake assembly 146 is located at one end (the right end) of the main portion 32 of apparatus 10 for providing resistance to the rotation of the tension roller 134. The resistance to the rotation of the tension roller 134 maintains the correct tension on the fabric web 14 during the wrapping process. The spring-loaded brake assembly 146 comprises a rotatable brake member 148 having an annular portion 150 surrounding the rotatable shaft 136 and a disk portion 152 extending outwardly from the annular portion 150 of the rotatable brake member 148. A key 154 secures the rotatable brake member 148 to the rotatable shaft 136 so both rotate together. When fabric is pulled through the main portion 32 of apparatus 10, the tension roller 134 rotates along with the rotatable shaft 136 which causes the rotatable brake member 148 to rotate. The spring-loaded brake assembly 146 further comprises a stationary inner brake member 156 having a groove 158 inside which resides a pin 160, as shown in FIG. 8. As shown in FIG. 8, the pin 160 extends outwardly from stationary plate 162, the stationary plate 162 being secured to an outer surface of one of the horizontally oriented middle side members 62 of one of the sides 46 with fasteners 163.

The spring-loaded brake assembly 146 further comprises an outer brake disk 164 which has a plurality of openings 166 through which pass bolts 168 (only one being shown in cross-section in FIG. 8). Each bolt 168 has a head 170 inside the stationary inner brake member 156 and a removable nut 172 secured to a threaded outer end of the bolt 168. A spring 174 surrounds each bolt 168 between the removable nut 172 and the outer brake disk 164 to exert an inwardly directed force shown by arrows 175 shown in FIG. 8. As shown in FIG. 8, an inner liner 176 is located between the stationary inner brake member 156 and the rotatable brake member 148 to avoid metal to metal contact. Similarly, an outer liner 178 is located between the outer brake disk 164 and the rotatable brake member 148 to avoid metal to metal contact. The inner and outer liners 176, 178 are made of nylon, but may be made of any common brake lining material. The springs 174 are selected to exert a desired amount of compression force to the liners which squeeze the rotatable brake member 148 therebetween thereby slowing the rotation of the rotatable shaft 136 and rotatable tension roller 134 surrounding rotatable shaft 136.

Figure 5:
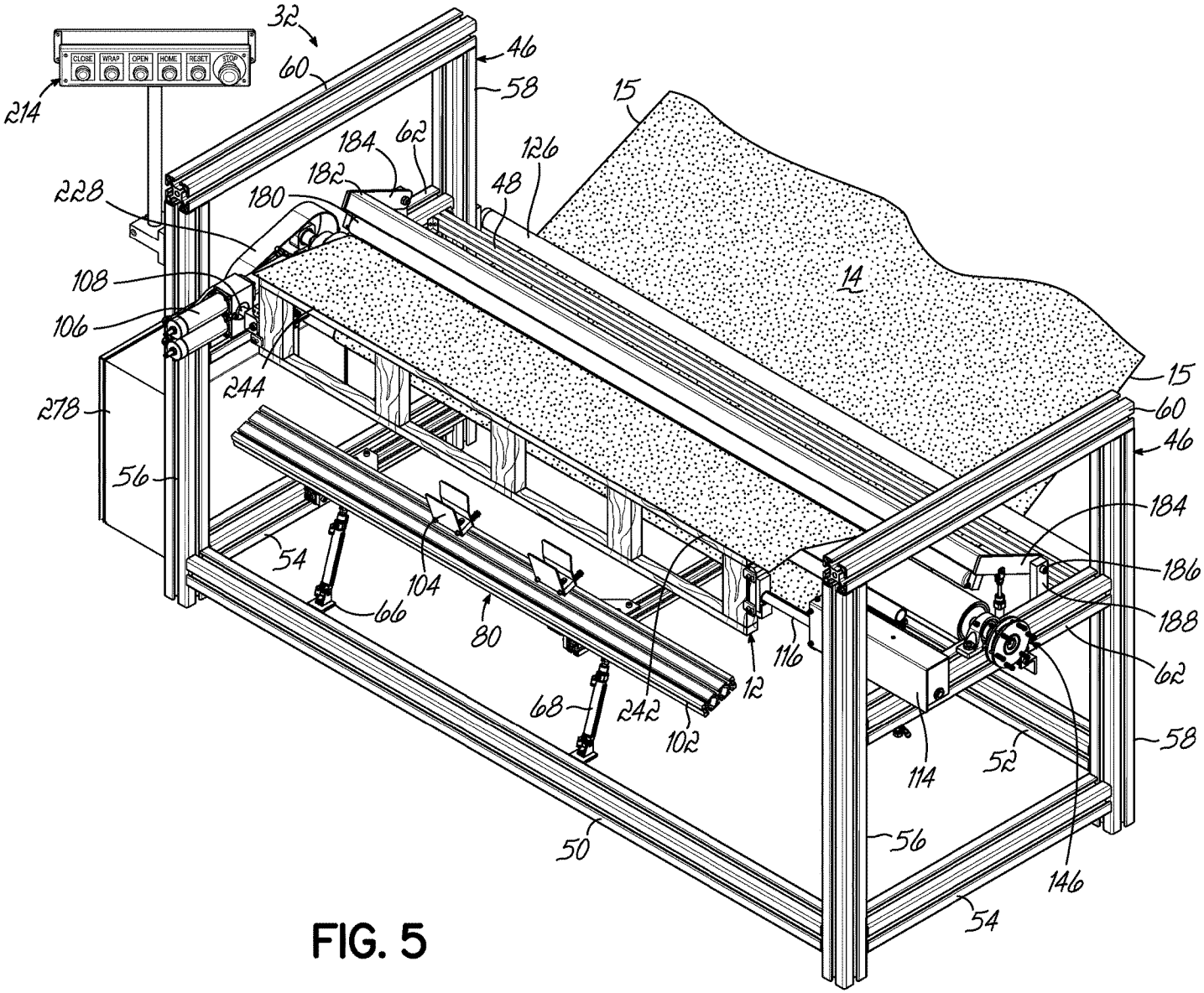
FIG. 5 is a perspective view of the apparatus of FIG. 1, showing the truss clamped or pinched between the vise mechanisms and the truss holder being in its lowered position.

As best illustrated in FIGS. 5 and 6, the main portion 32 of apparatus 10 further comprises a non-rotatable pressure shaft 180 welded or otherwise secured to a pressure bar 182 extending from right-to-left between side links 184. As best shown in FIG. 6, each of the side links 184 is pivotally joined at locations 186 to stationary links 188 which are secured to one of the horizontally oriented middle side members 62 of one of the sides 46 with fasteners 190.

As best shown in FIG. 6, a pneumatic tensioner 200 exerts a desired amount of pressure on the fabric as the fabric wraps around the tension roller 134. Each pneumatic tensioner 200 comprises a pneumatic tension cylinder 192 pivotally secured at location 193 to one of the horizontally oriented middle side members 62 of one of the sides 46 with a tension bracket 194. A tension rod 196 is pivotally secured to each of the side links 184 at its upper end to pivot about location 198.

As best illustrated in FIG. 6, the main portion 32 of apparatus 10 further comprises a lifter 202 comprising a non-rotatable lifter bar 204 raised and lowered by a pneumatic piston 206 and cylinder 208. Each pneumatic cylinder 208 is mounted to one of the horizontally oriented middle side members 62 of one of the sides 46 with a lifter bracket 210. The two lifters 202 function to lift the fabric web 14 extending through the main portion 32 of apparatus 10 for purposes of cutting the fabric web 14 at the end of the process described herein.

As best shown in FIG. 6, two stabilizers 212 assist controlling movement of the truss holder 102. Each stabilizer 212 is secured at its upper end to truss holder 102. As best shown in FIG. 2B, each stabilizer 212 is secured at its lower end to one of the lift arms 74. The two stabilizers 212 help fix the location of the truss holder 102 relative to the lift arms 74 and provide stability to the truss holder 102 during movement thereof.

As best shown in FIGS. 1 and 2, the main portion 32 of apparatus 10 further comprises a control panel 214 having from left to right: a close button 216, a wrap button 218, an open button 220, a home button 222 and a stop button 224.

Figure 10A:
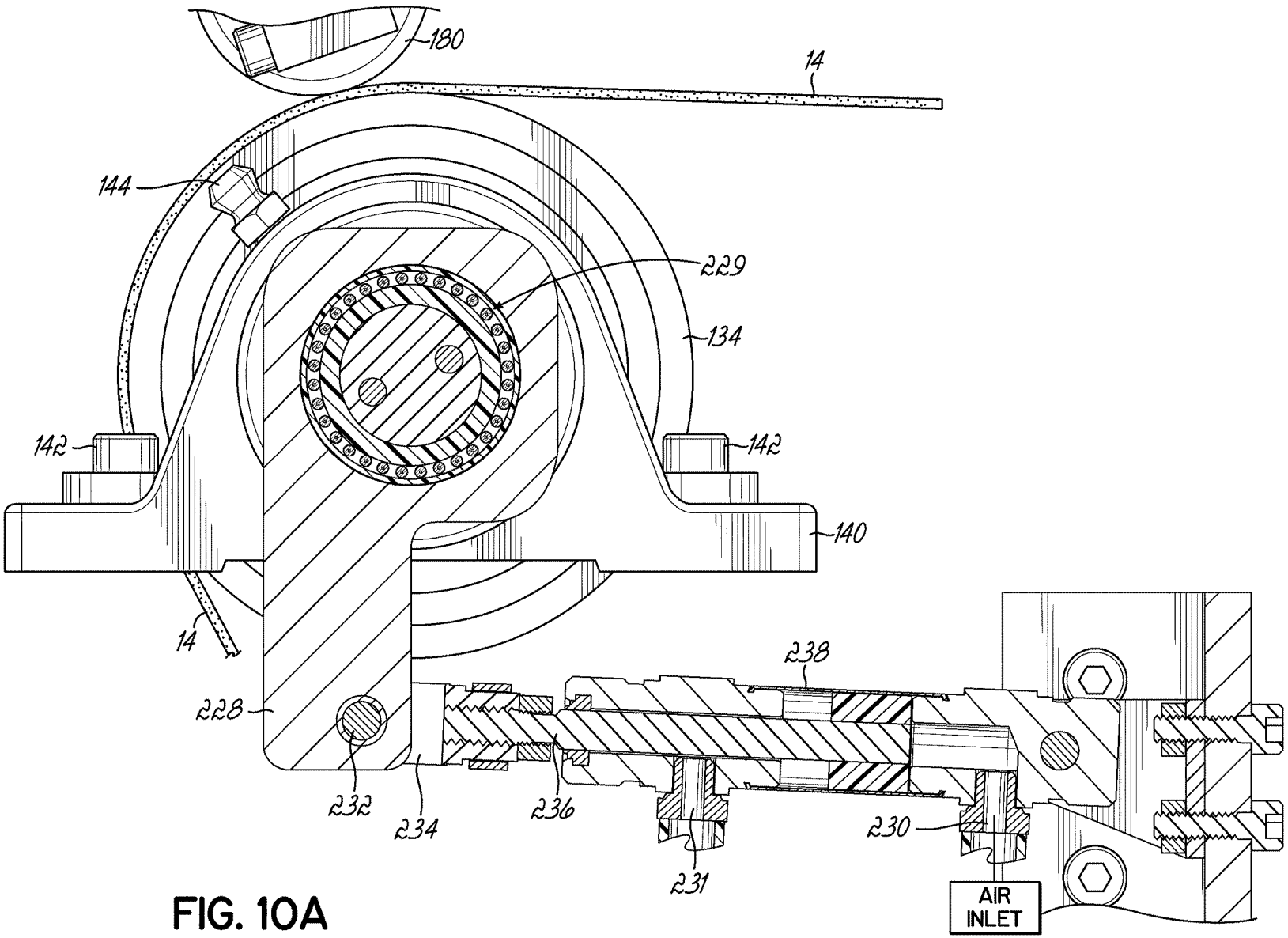
FIG. 10A is a cross sectional view taken along the line 10A-10A of FIG. 9.
Figure 10B:
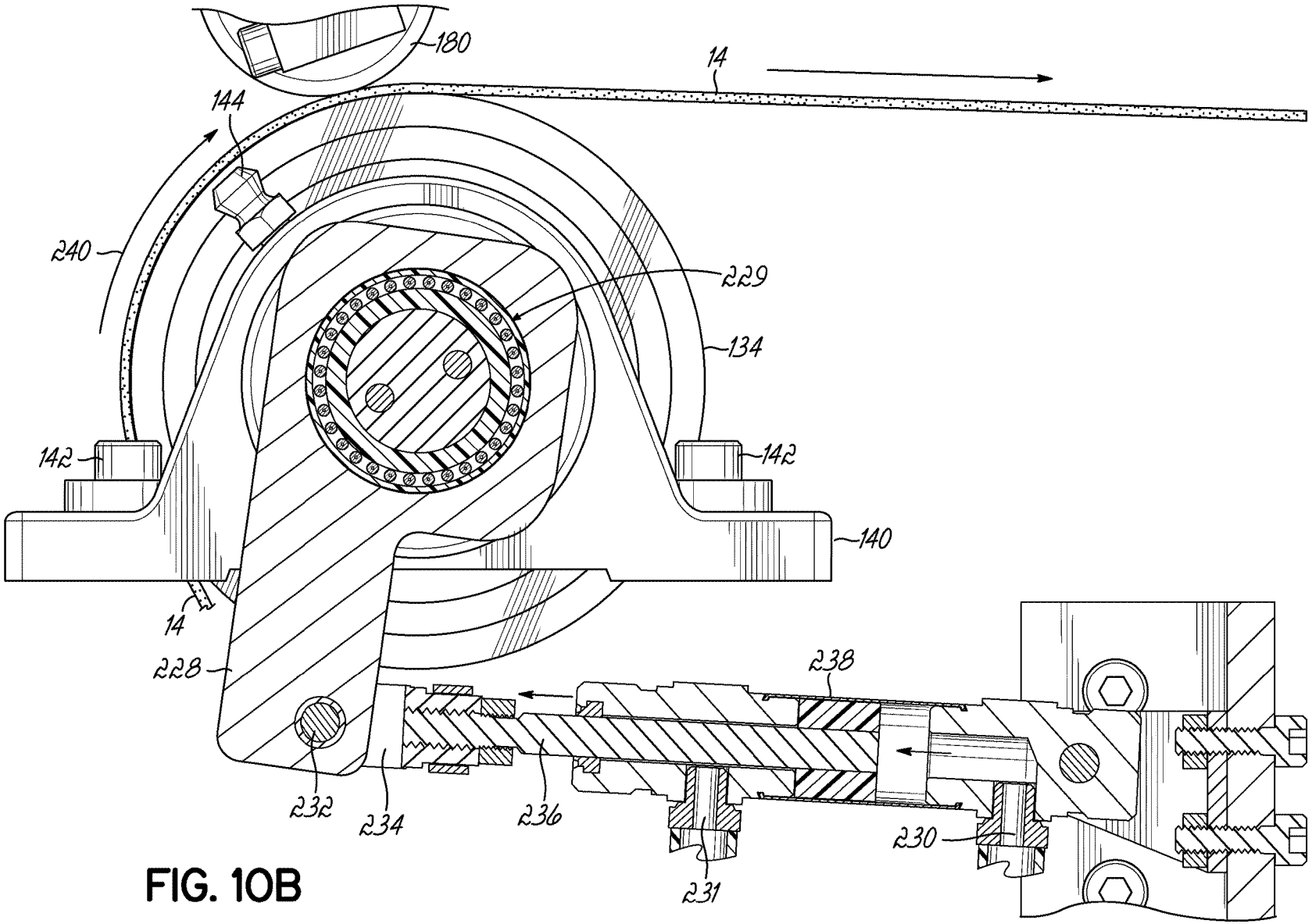
FIG. 10B is a cross sectional view showing movement of the ratchet of FIG. 10A.
Figure 10C:
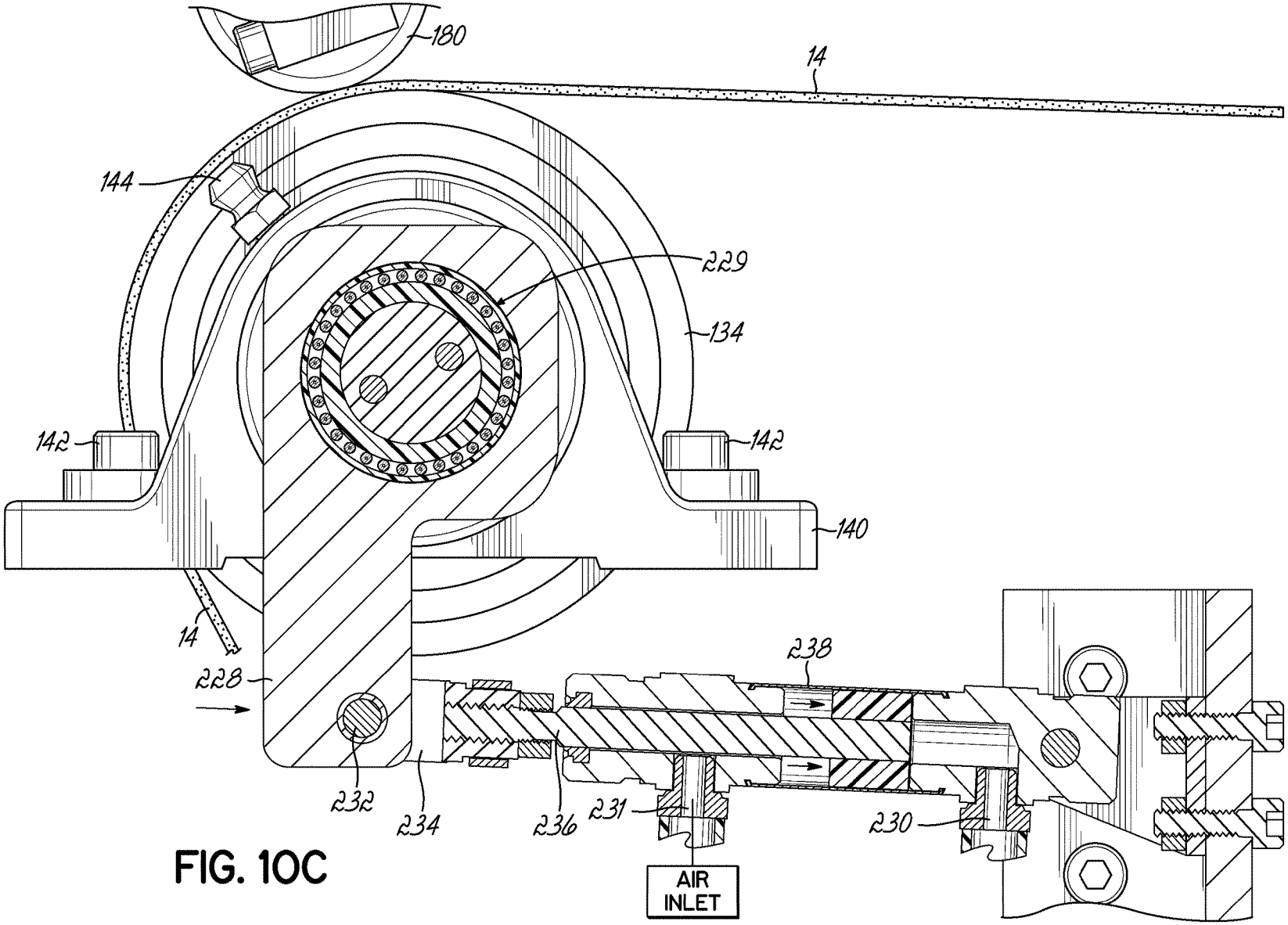
FIG. 10C is a cross sectional view showing movement of the ratchet of FIG. 10A.

As best shown in FIGS. 9-10C, the main portion 32 of apparatus 10 further comprises a ratchet unit 226 protected by a cover 228 shown in FIGS. 1 and 2 on the left side of the main portion 32 of apparatus 10. As best shown in FIG. 9, ratchet unit 226 comprises a ratchet housing 228, a one way bearing 229 secured in the ratchet housing 228, two pneumatic ports 230, 231, a pivot pin 232 securing a U-shaped bracket 234 to the ratchet housing 228, a piston 236 movable inside a pneumatic cylinder 238. FIG. 10A illustrates the piston 236 in its home position and air entering the pneumatic port 230. FIG. 10B illustrates the piston 236 moving left or extending outwardly from its home position and moving the ratchet housing 228 in a clockwise direction as shown by arrow 240. The clockwise movement of the ratchet housing 228 moves the tension roller 134 in a clockwise direction. FIG. 10C illustrates the piston 236 returning to its home position and air entering the pneumatic port 231.

Figure 4:
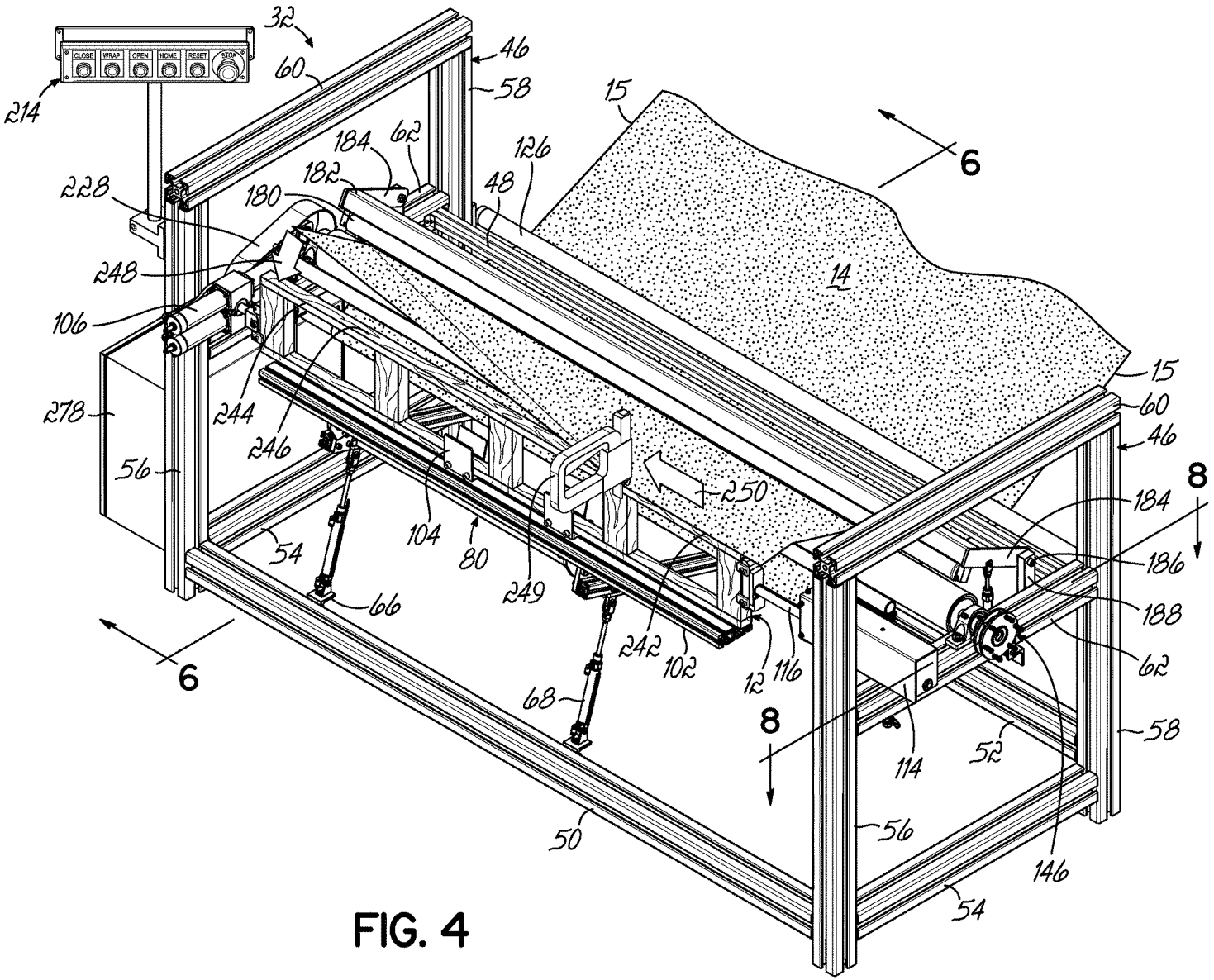
FIG. 4 is a perspective view of the apparatus of FIG. 1, showing the fabric being initially stapled to the truss with a stapler (the operator not being shown).
Figure 7A:
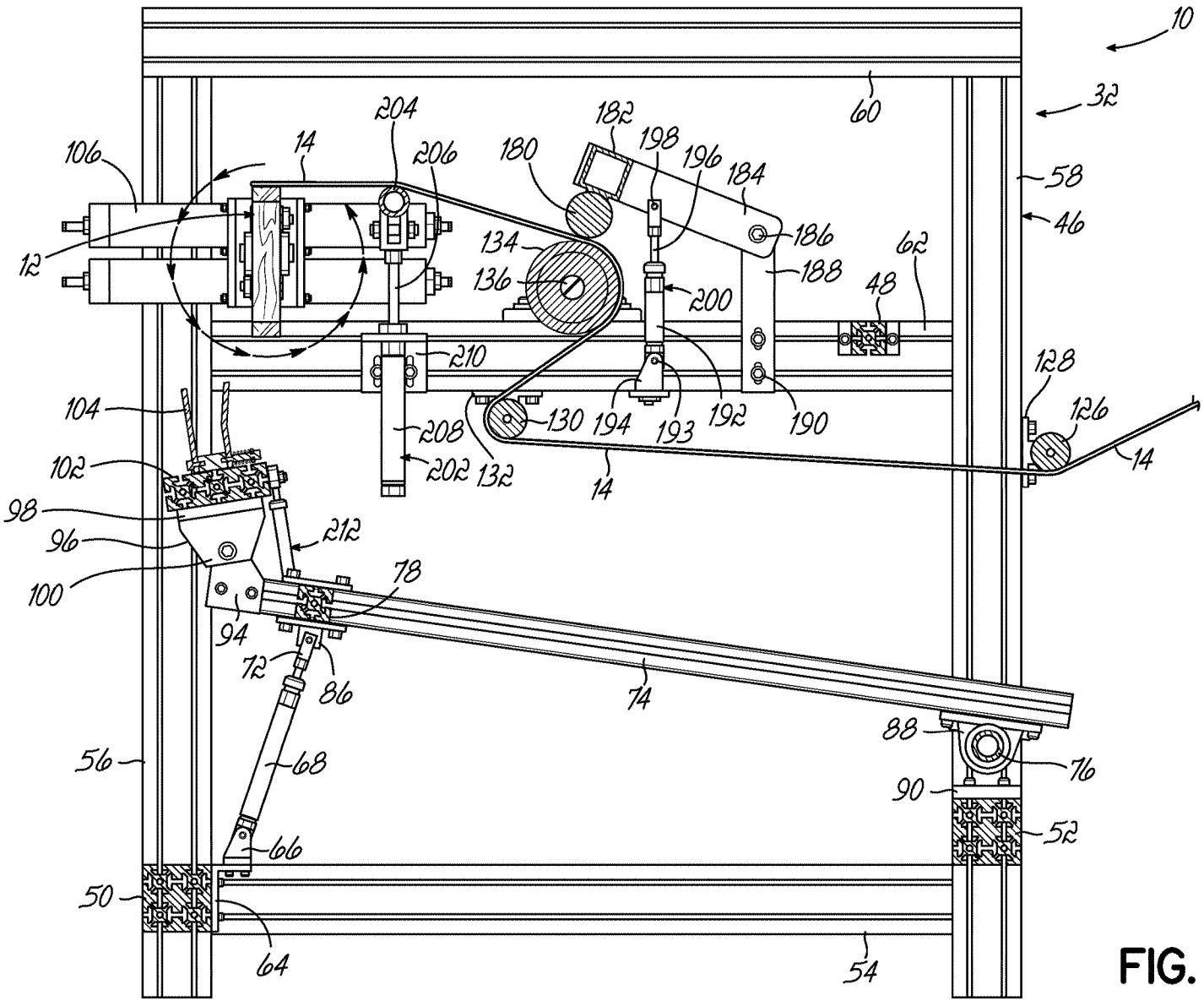
FIG. 7A is a cross sectional view, similar to FIG. 6, showing the truss holder in its lowered position and the pinched truss being rotated by the vise mechanisms.
Figure 7B:
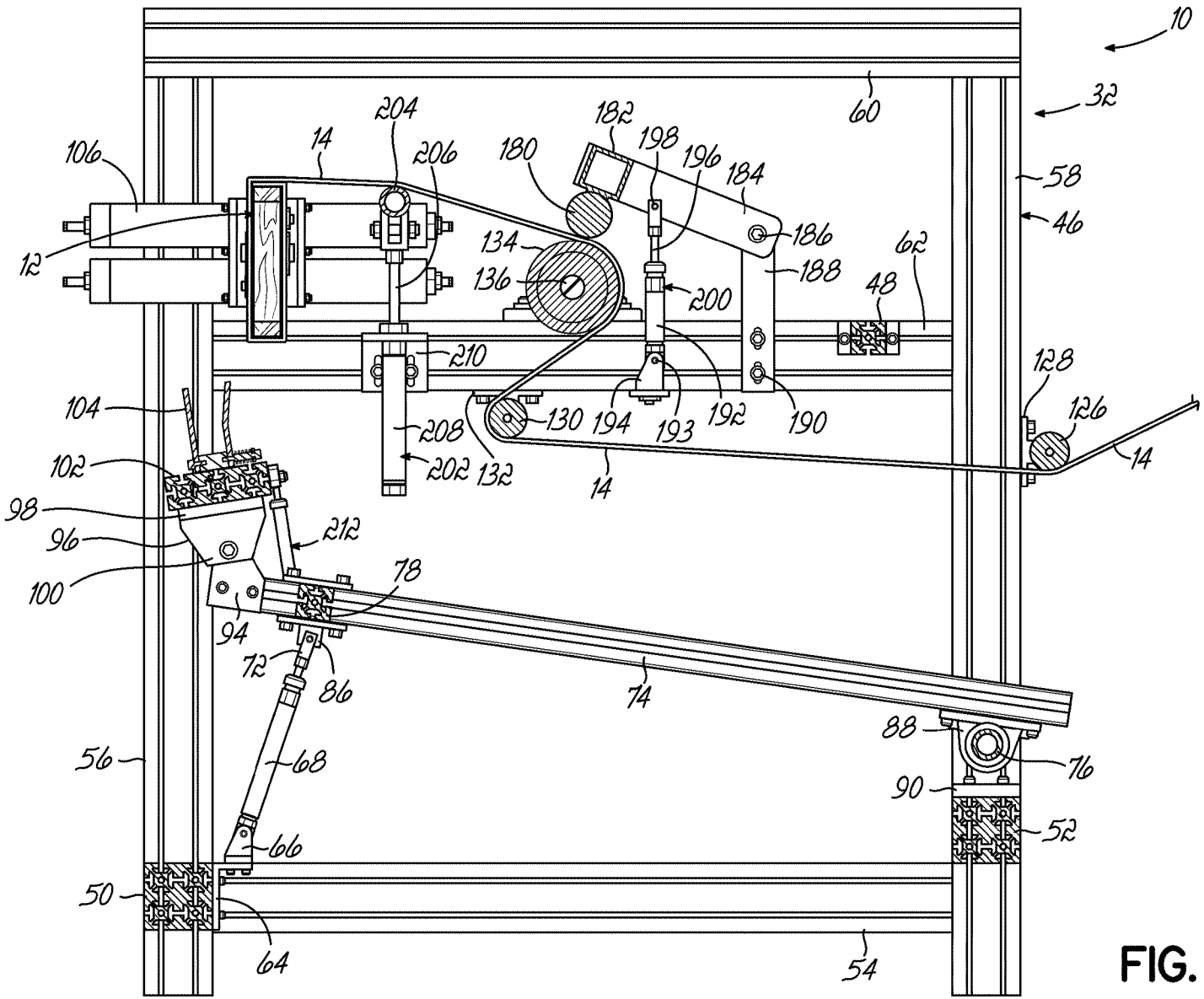
FIG. 7B is a cross sectional view, similar to FIG. 7A, showing the truss holder in its lowered position and the pinched truss having completed one full rotation.

The ratchet unit 226 functions to advance the fabric web 14 the width (the linear distance from the front edge to the rear edge of the upper member) of a truss 12. As shown in FIG. 7D, after the fabric web 14 is cut along the rear edge of the upper member 16 of a truss 12, the fabric web 14 must be advanced to the front edge of the upper member 16 of the next truss 12 to be wrapped. The ratchet unit 226 advances the fabric web 14 this linear distance so the front edge of the fabric web 14 aligns with the front edge of the upper member 16 of the truss 12 as shown in FIG. 4.

As best shown in FIGS. 1 and 2, an electrical enclosure 278 is secured to the left side 46. Each of the cylinders described herein is pneumatically controlled to move the piston or rod associated with it between extended and retracted positions. Any known pneumatic control system may be used to activate the cylinders.

Turning to the method of operation of the apparatus 10, FIG. 2 shows a truss 12 being inserted onto the truss holder 102 between two sets of spring biased clamps 104. FIG. 3A shows the left vise mechanism 106 in its home position and the right vise mechanism 114 in its home position. FIG. 3A shows the truss 12 spaced from each of the jaws of the left and right vise mechanisms 106, 114, respectively.

After an operator pushes the close button 216 on the control panel 214, the rotatable shaft 116 of the right vise mechanism 114 extends outwardly towards the left vise mechanism 106 from the housing 115. The jaw 120 of the right vise mechanism 114 contacts the right end surface 122 of the truss 12 and pushes the truss 12 to the left until the left end surface 124 of truss 12 contacts the jaw 112 of the left vise mechanism 106. The rotatable shaft 116 of the right vise mechanism 114 extends outwardly further until the truss 12 is sandwiched between the jaws 112, 120 of the left and right vise mechanisms 106, 114, respectively.

FIG. 4 illustrates a front edge 242 of the fabric web 14 being pulled forwardly to align with a front edge 244 of the upper member 16 of the truss 12. See arrow 248 in FIG. 4. An operator then staples the fabric web 14 to the upper surface 246 of the upper member 16 of the truss 12 with a stapler 249. The stapler 249 is shown moving right to left by the arrow 250 in FIG. 4, but may move the opposite direction.

Figure 4A:
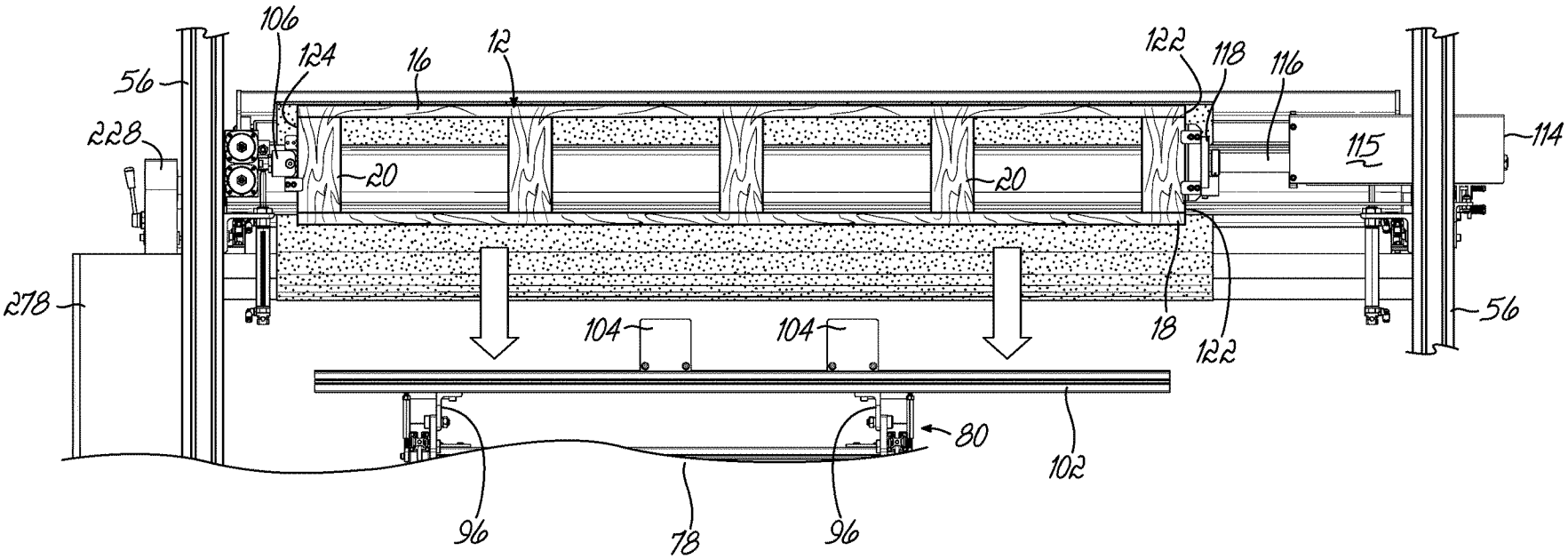
FIG. 4A is a front elevational view of a truss clamped or pinched between the vise mechanisms and the truss holder being lowered.

An operator then hits the wrap button 218 on control panel 214 which causes the truss holder 102 to lower as shown in FIGS. 4A and 5. At this point, the truss 12 is suspended and supported by only the vise mechanisms 106, 114. The truss 12 is sandwiched and clamped between the jaws 112, 120 of the vise mechanisms 106, 114, respectively. As shown in FIG. 5, the truss holder 102 is in its lowered position. As shown in FIG. 7A, the vise mechanisms 106, 114 rotate the suspended truss 12 in a counter-clockwise direction until the suspended truss 12 becomes fully wrapped in fabric, as pictured in FIG. 7B. As shown in FIG. 7B, the fabric web 14 passes over the portion of the fabric web 14 already stapled or secured to the upper surface 246 of the upper member 16 of truss 12.

Figure 7C:
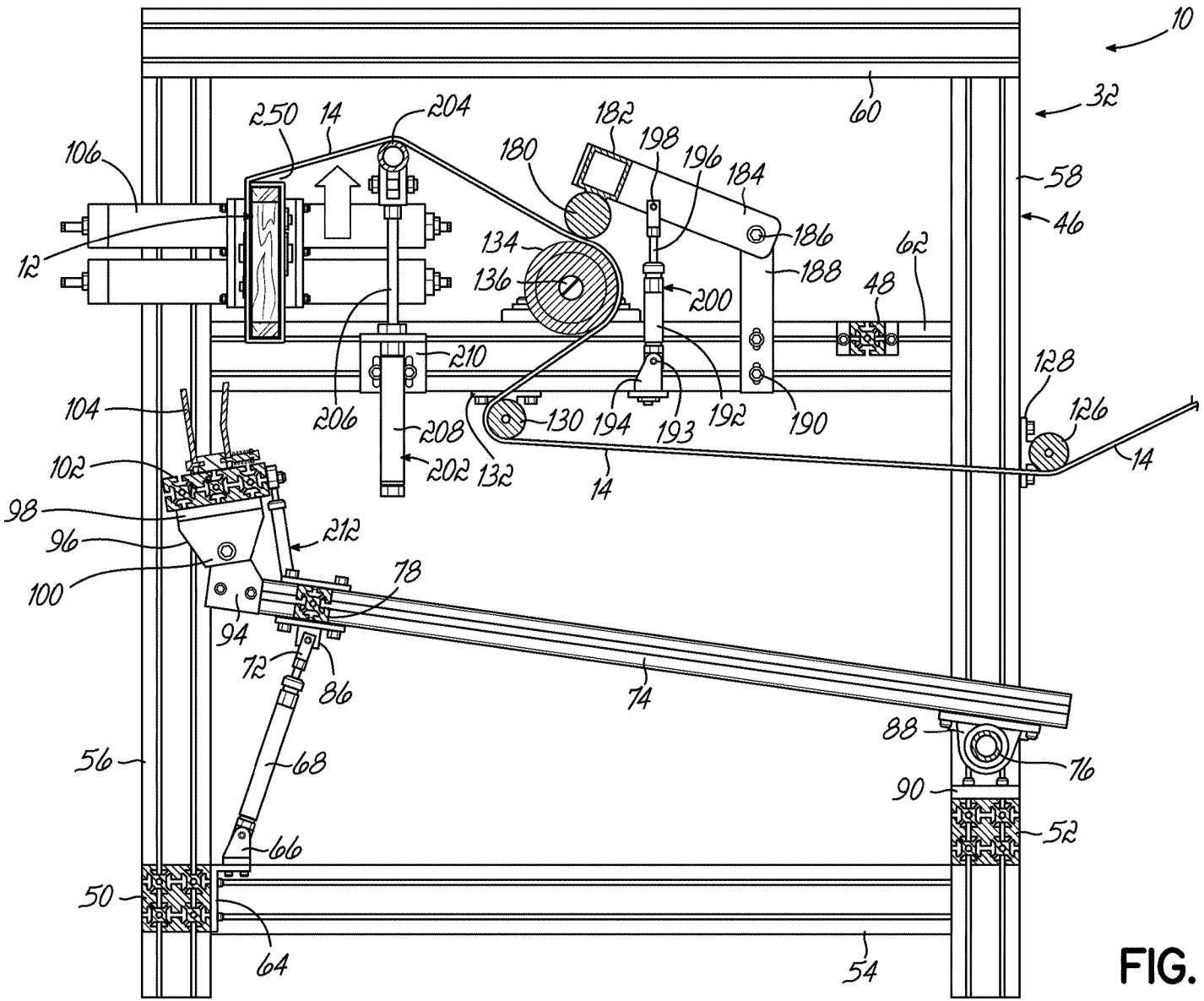
FIG. 7C is a cross sectional view, similar to FIG. 7B, showing the tension bar being in its raised position to facilitate cutting the fabric.
Figure 7D:
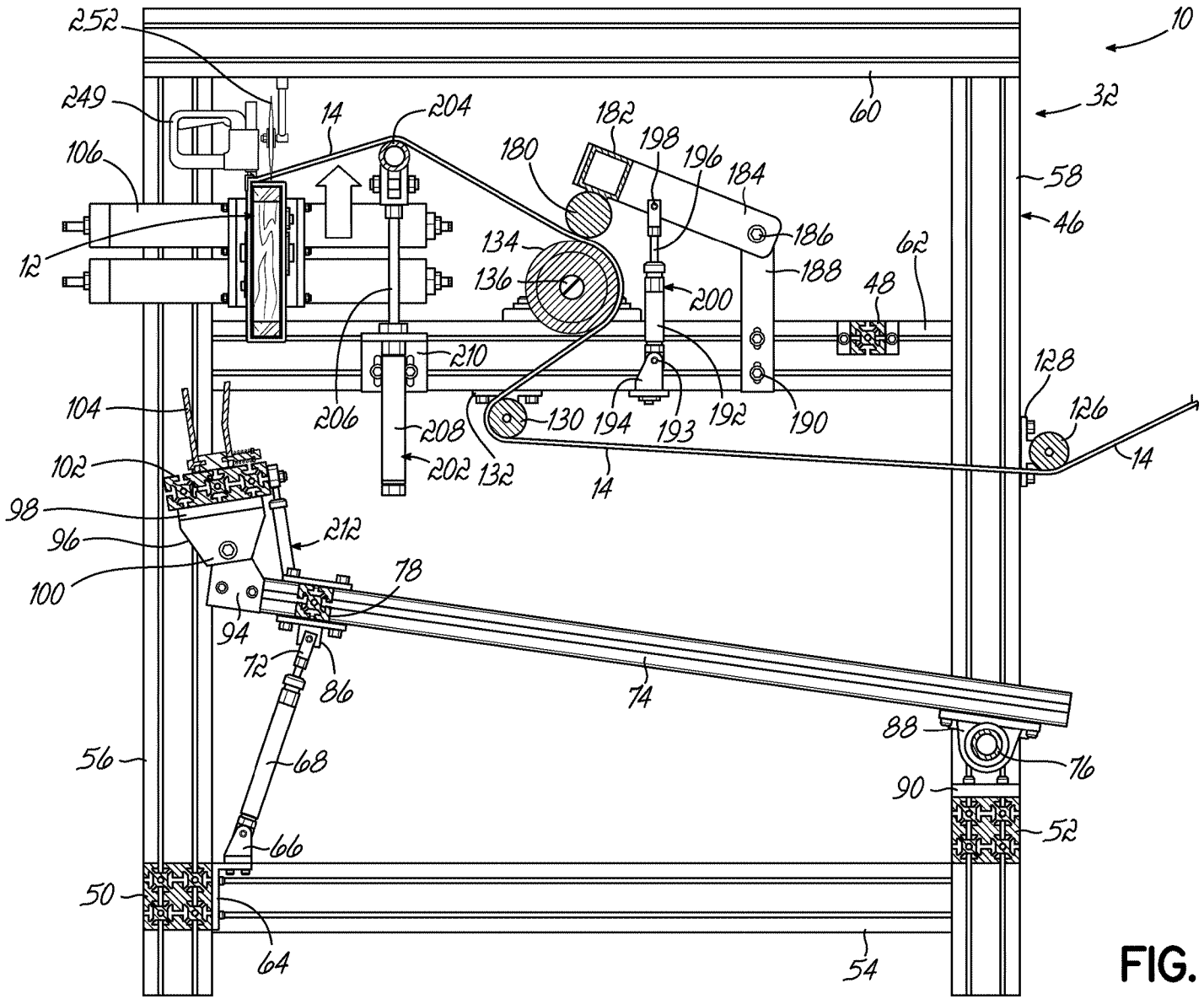
FIG. 7D is a cross sectional view, similar to FIG. 7C, showing the raised fabric being cut with a cutter blade.
Figure 11A:
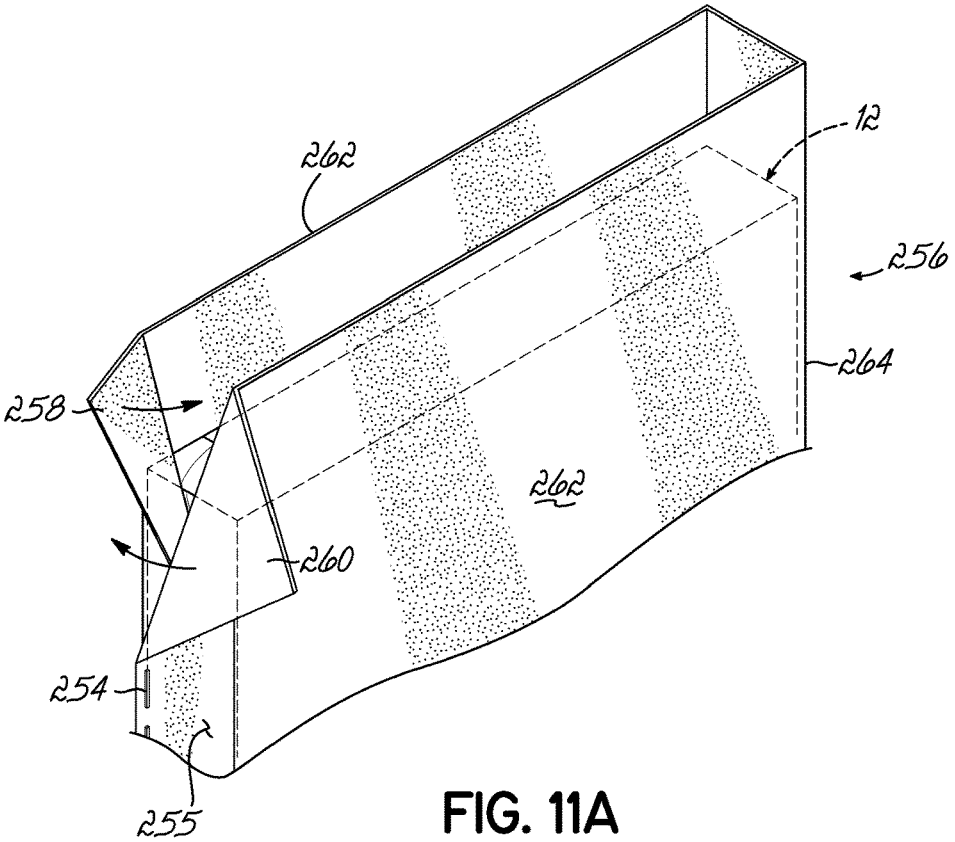
FIG. 11A is a perspective view showing folding and stapling of the fabric along an upper surface of a partially finished truss.

As shown in FIG. 7C, after the rotation of the jaws 112, 120 of the vise mechanisms 106, 114, respectively, the lifter bar 204 raises up to lift the fabric web 14 immediately behind the suspended truss 12. This movement creates a gap 250 which makes it easier for a blade 252 to move along and cut the fabric web 14 as shown in FIG. 7D. After the fabric web 14 is stapled to the top of the truss 12, it is cut to create a partially finished truss 256. See staples 254 in FIG. 11A. As shown in FIG. 11A, when the stapling is done, the top surface 255 of the partially finished truss 256 has two layers, a lower layer 258 and an upper layer 260. The two side surfaces 262 and bottom surface 264 of the partially finished truss 256 have only one layer, as shown in FIG. 11A. After the last staple 254 is inserted, an operator pushes the open button 222 on control panel 214 which causes the jaw 120 and shaft 116 of the vise mechanism 114 to retract linearly (move to the right) to separate the jaws and allow the partially finished truss 256 to be pulled off the truss holder 102.

Figure 11B:
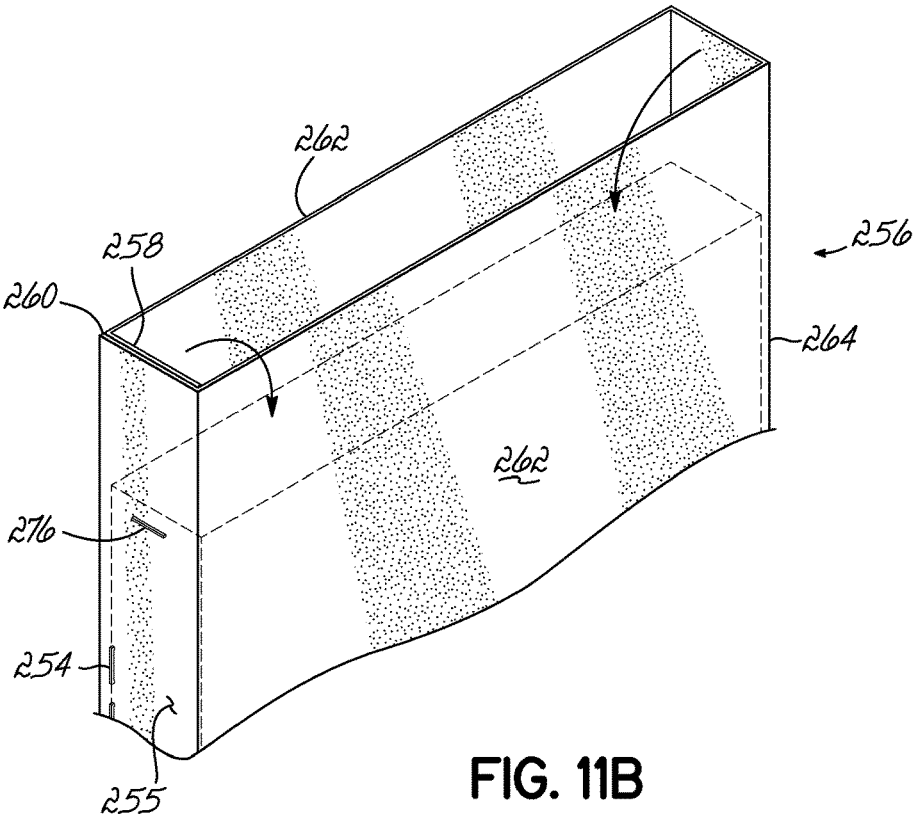
FIG. 11B is a perspective view showing folding of the fabric along an end surface of the partially finished stapled truss of FIG. 11A.
Figure 11C:
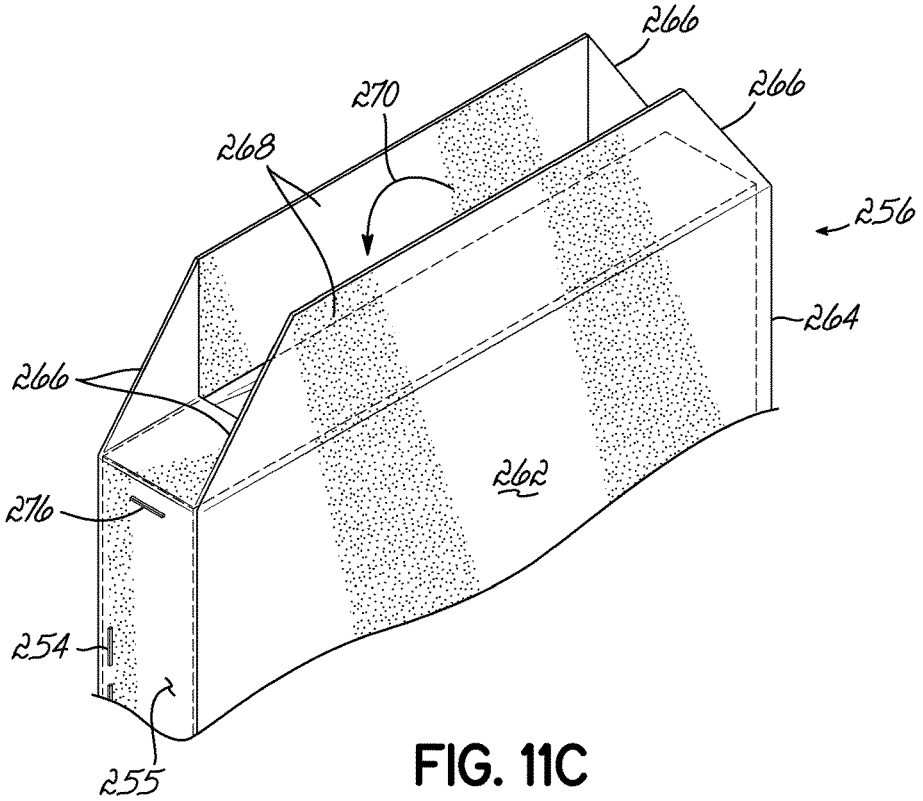
FIG. 11C is a perspective view showing further folding of the fabric along an end surface of the partially finished truss of FIG. 11B.
Figure 11D:
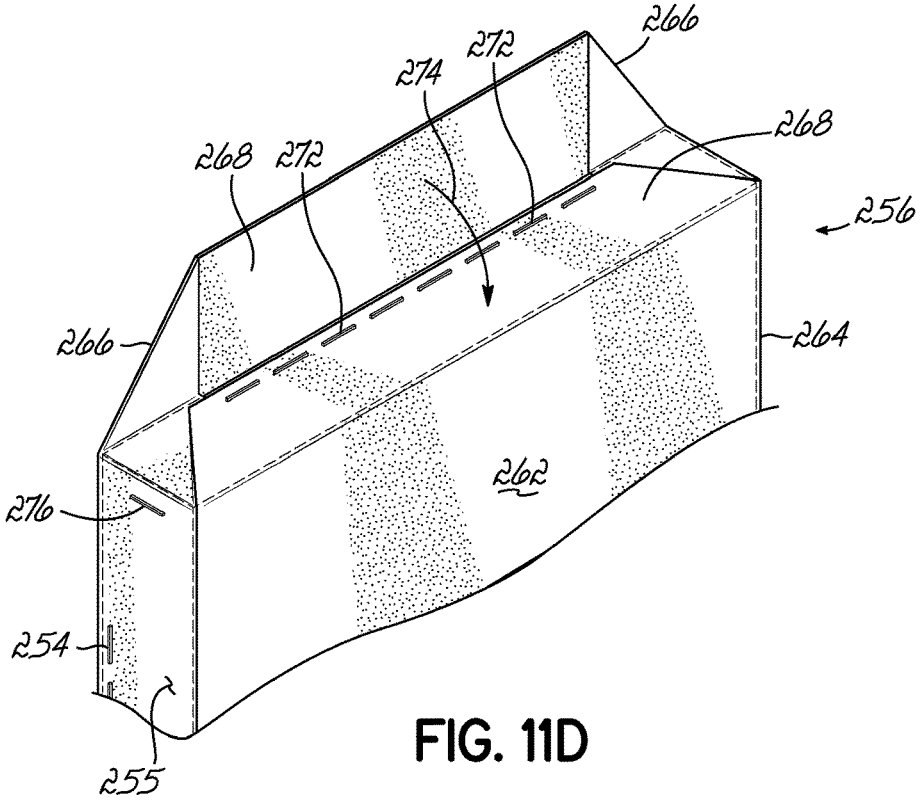
FIG. 11D is a perspective view showing stapling and further folding of the fabric along an end surface of the partially finished truss of FIG. 11C.
Figure 11E:
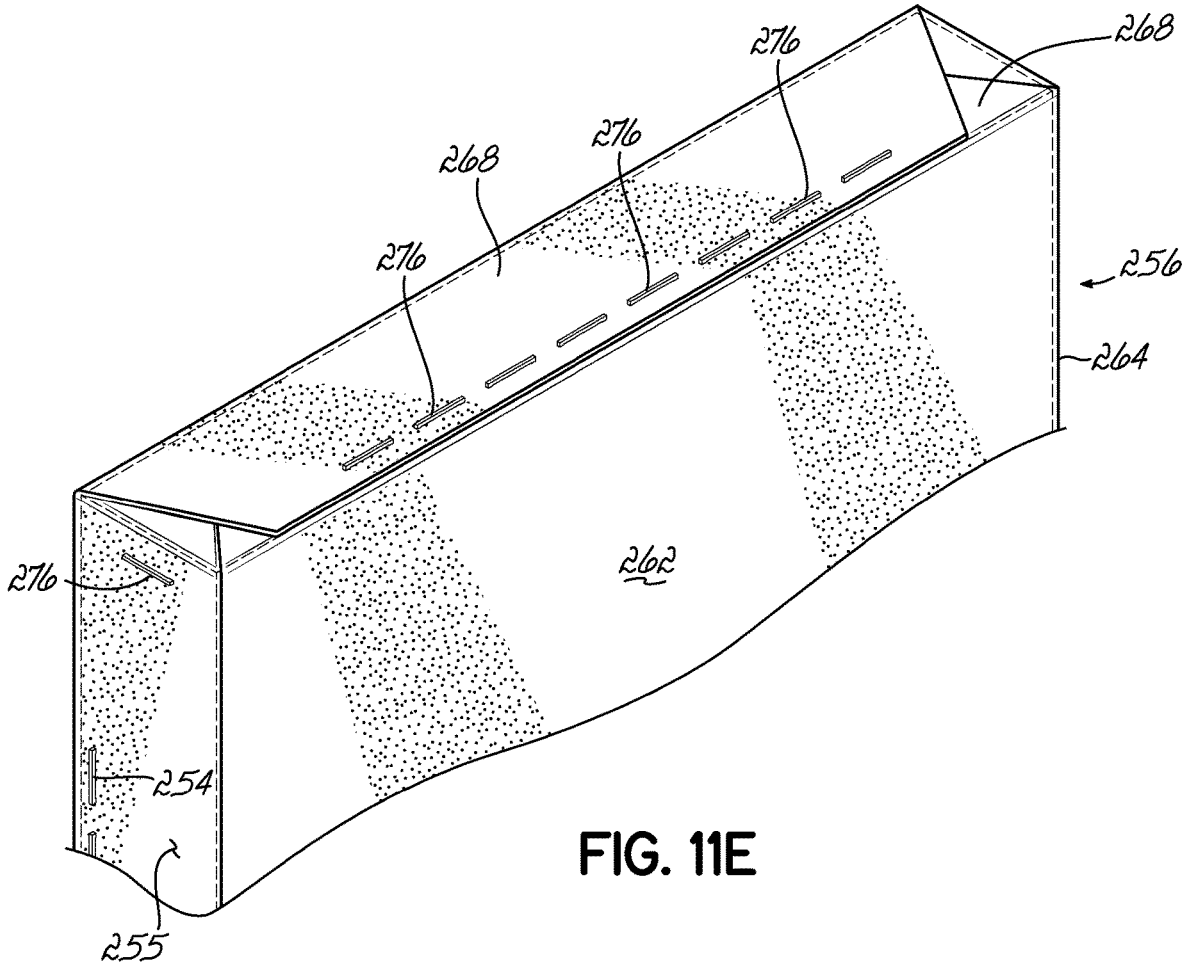
FIG. 11E is a perspective view showing a finished end surface of the truss of FIG. 11D.

As shown in FIG. 11B, at each end of the partially finished truss 256 (only one being shown) the fabric is further secured in place with staple 276. As shown in FIG. 11C, at each end of the partially finished truss 256 (only one being shown) the fabric is folded along fold lines 266 to form two tabs 268. One of the tabs 268 is folded downwardly as shown by arrow 270 in FIG. 11C to contact the exposed end surface of the partially finished truss 256 and stapled in place with staples 272. As shown in FIG. 11D, the other tab 268 is folded over the top of the stapled tab 268 in the direction of arrow 274 and secured in place with staples 276 as shown in FIG. 11E.

Figure 12A:
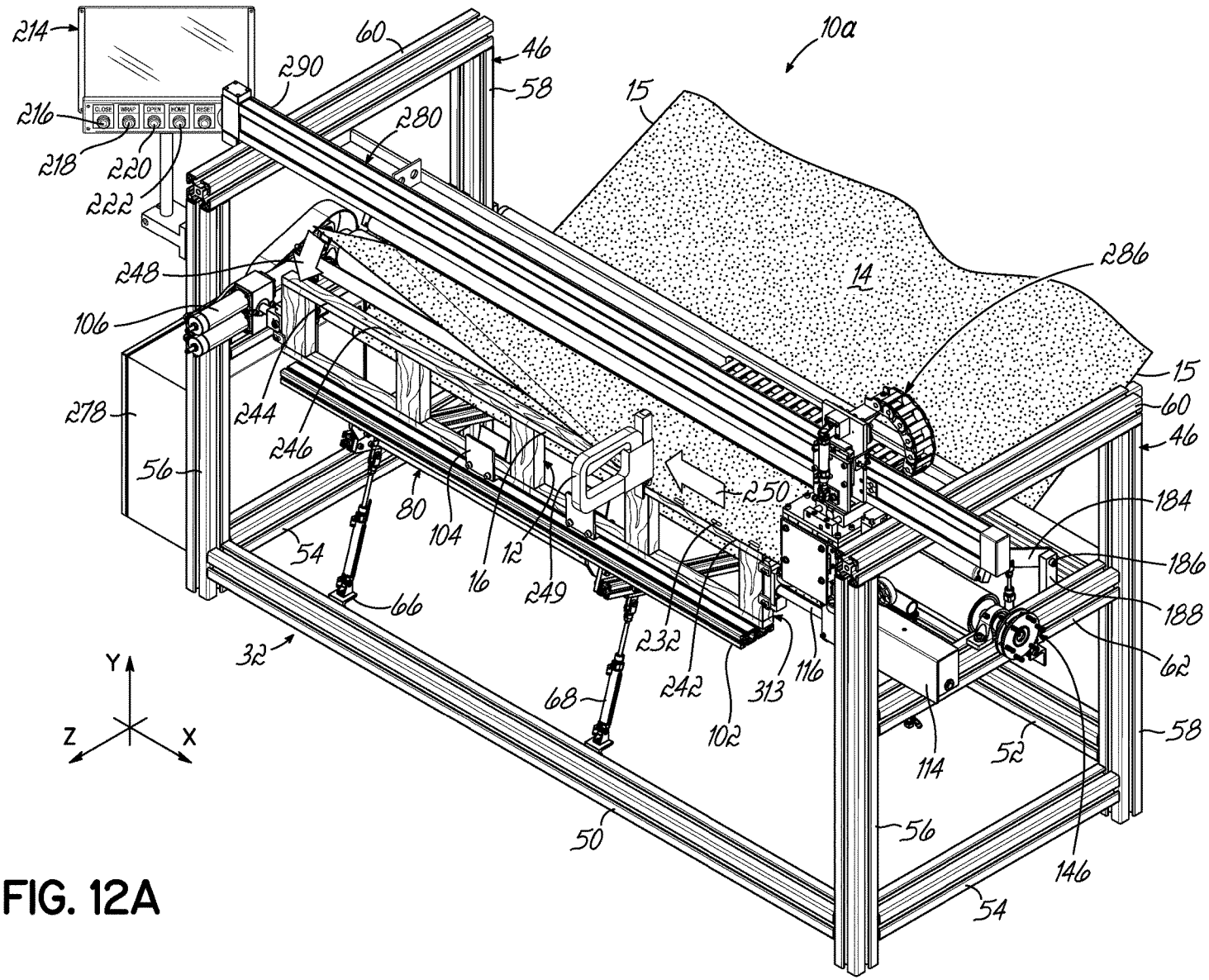
FIG. 12A is a front perspective view of an alternative embodiment of apparatus having an automated stapler/cutter including a movable carriage.

FIGS. 12A-16 illustrate an alternative apparatus 10*a* for upholstering a truss 12 for a bedding foundation (not shown) with fabric supplied by a roll 22. The alternative apparatus 10*a* is identical to the apparatus 10 shown in FIGS. 1-11 and described herein, but has additional features to automate the process of wrapping a truss. One additional feature is an automated stapler/cutter 280 which automates the process except for the manual steps of: 1) initially stapling the fabric web 14 to the upper surface 246 of the upper member 16 of the truss 12 to create an initially stapled truss 313 as shown in FIG. 12A, and 2) FIG. 12A illustrates a front edge 242 of the fabric web 14 being pulled forwardly to align with a front edge 244 of the upper member 16 of the truss 12. See arrow 248 in FIG. 12A. An operator (not shown) then manually staples the fabric web 14 to the upper surface 246 of the upper member 16 of the truss 12 with a stapler 249. The stapler 249 is shown moving right to left by the arrow 250 in FIG. 12A. However, the operator may move the stapler 249 manually in the opposite direction. During this process of the operator manually stapling the fabric web 14 to the upper surface 246 of the upper member 16 of the truss 12 with staples 232, a movable carriage 286 of the automated stapler/cutter 280 is in a parked position off to the right side of the truss 12 so it does not interfere with the manual stapling or wrapping operations.

Figure 12B:
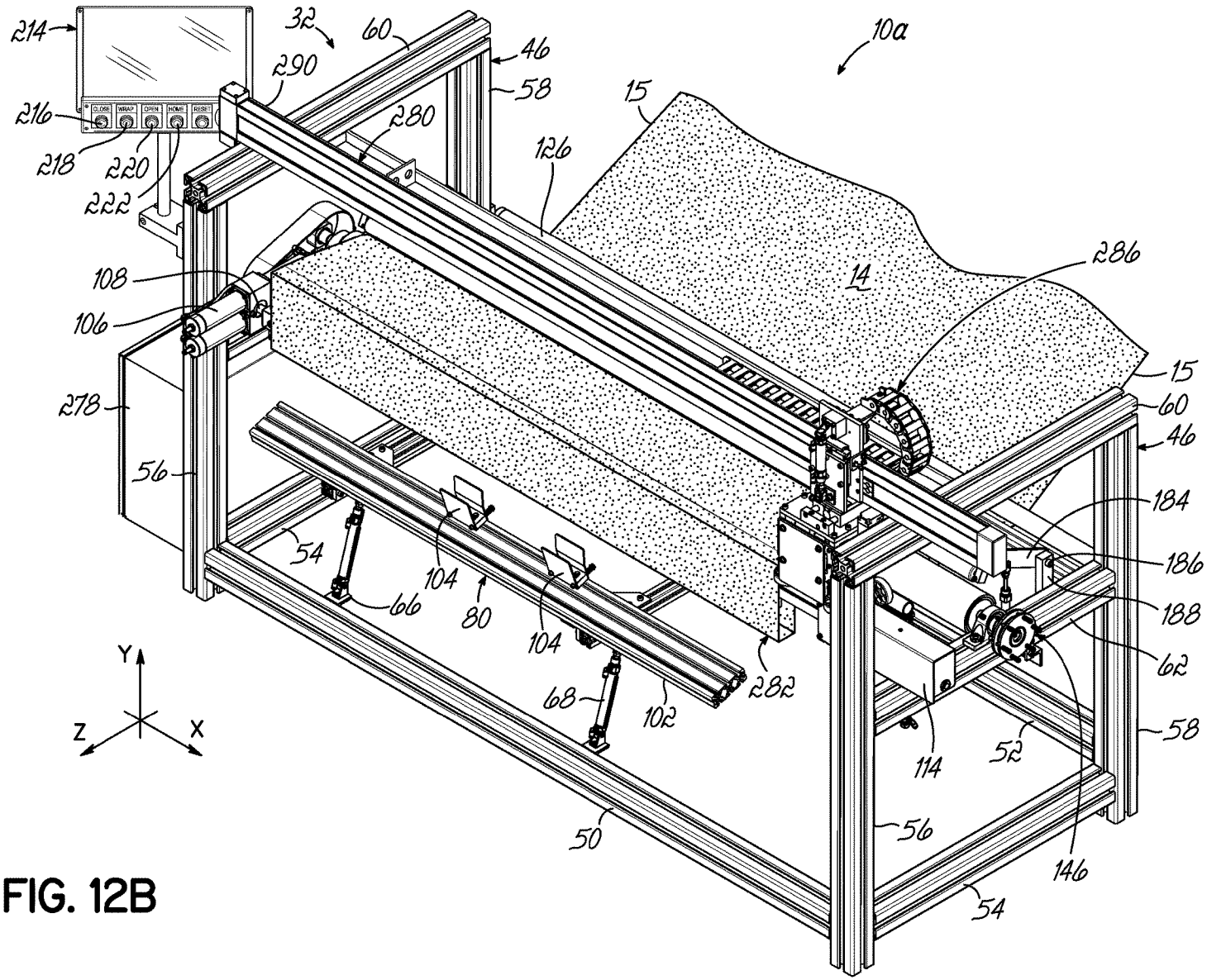
FIG. 12B is a front perspective view of the apparatus of FIG. 12A showing the automated stapler/cutter location prior to stapling a wrapped truss.

While the initially stapled truss 313 is rotated one full rotation to create a wrapped truss 282, the movable carriage 286 of the automated stapler/cutter 280 remains in its parked position off to the right side of the truss 12 so it does not interfere with the wrapping operation. As shown in FIG. 12B, after the initially stapled truss 313 is rotated one full rotation to create a wrapped truss 282, the movable carriage 286 of the automated stapler/cutter 280 passes over the wrapped truss 282 stapling as it travels along its first pass to create a partially finished truss 288 as shown in FIGS. 15B-15E. As shown in FIGS. 15D-15E, the movable carriage 286 then reverses direction, passing again over the partially finished truss 288 to cut the fabric separating the fabric of the truss from the remaining fabric web 14.

As best shown in FIGS. 12A and 12B, the automated stapler/cutter 280 comprises a linear actuator 290 which extends from side-to-side and is secured to the sides 46 of the apparatus 10*a*. More particularly, the linear actuator 290 is secured to the horizontally oriented top side members 60 of sides 46 and extends therebetween. As best shown in FIG. 15B, the linear actuator 290 is driven by a servo motor 292 and has a gear reducer 294 between the linear actuator 290 and servo motor 292. It will be appreciated by those in the art that any motor may be used to power the linear actuator 290. Any known linear actuator may be used, but one which has proven satisfactory is a compact module CKR from Bosch Rexroth Corporation at the website www.boschrexroth-us.com.

Figure 13B:
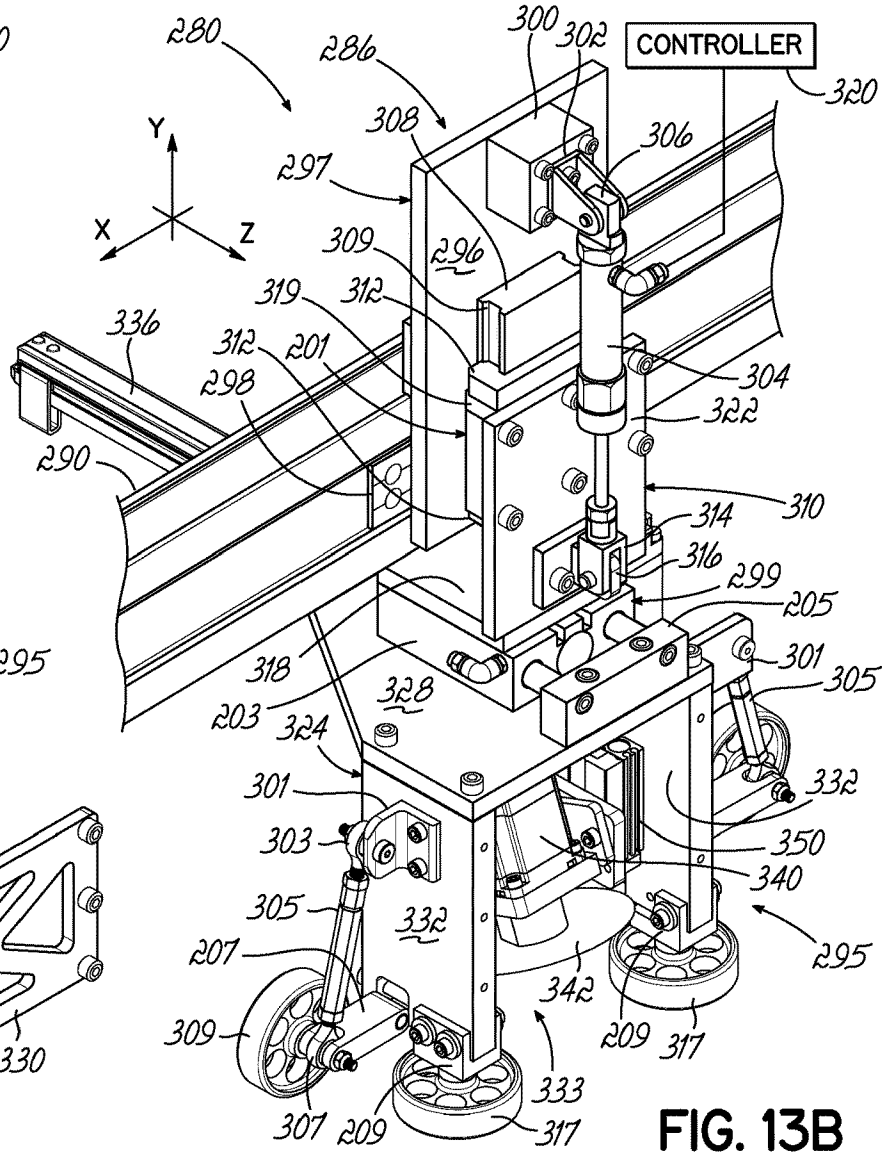
FIG. 13B is a front perspective view of the movable carriage of the automated stapler/cutter showing the sub-carriage in its lowered position.
Figure 13A:
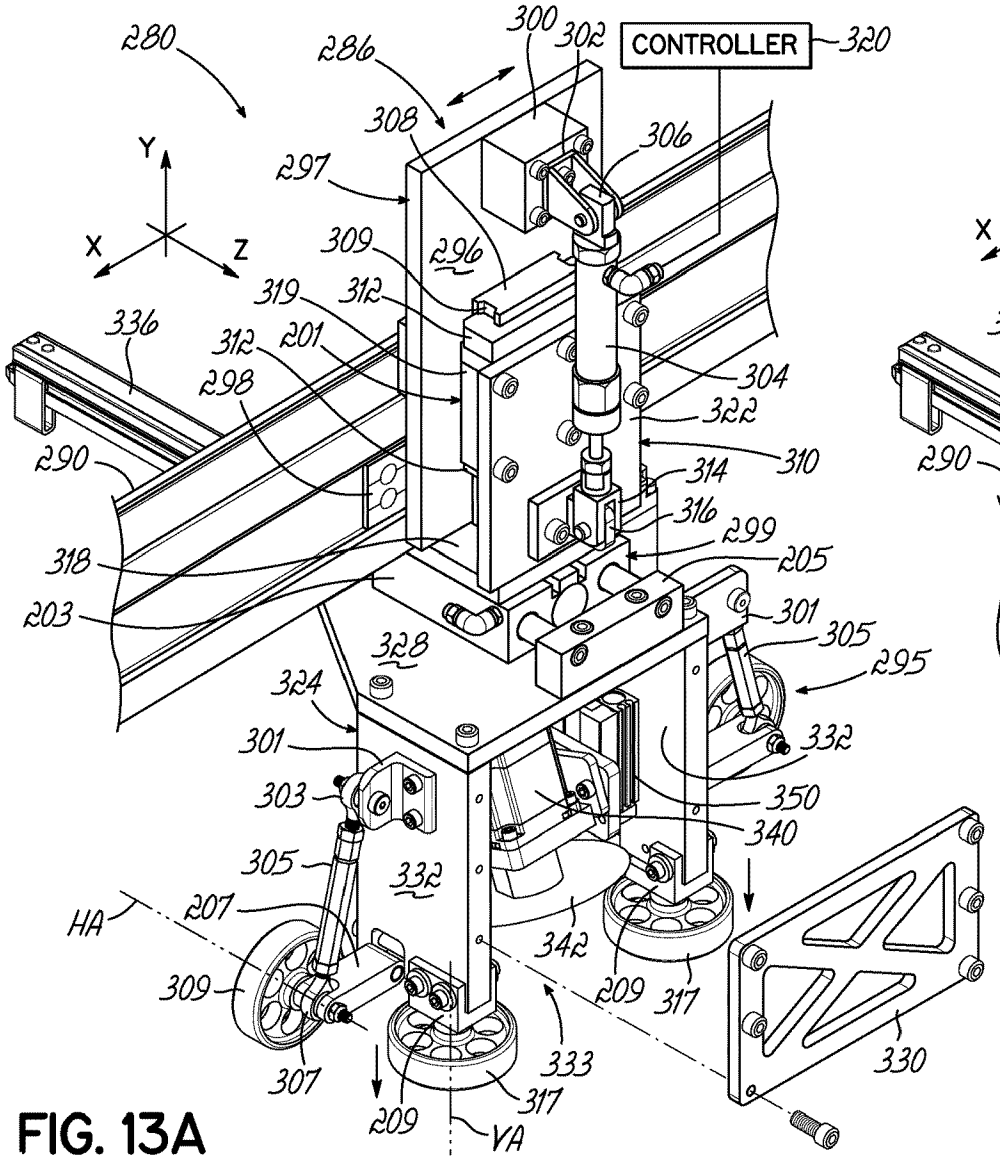
FIG. 13A is a front perspective view of the movable carriage of the automated stapler/cutter showing the sub-carriage in its raised position.

As best shown in FIGS. 13A-13B, the moveable carriage 286 as a whole is movable along the x-axis and is secured to a movable plate 298 of linear actuator 290. The moveable carriage 286 moves along the x-axis with the movable plate 298 of linear actuator 290.

Figure 14B:
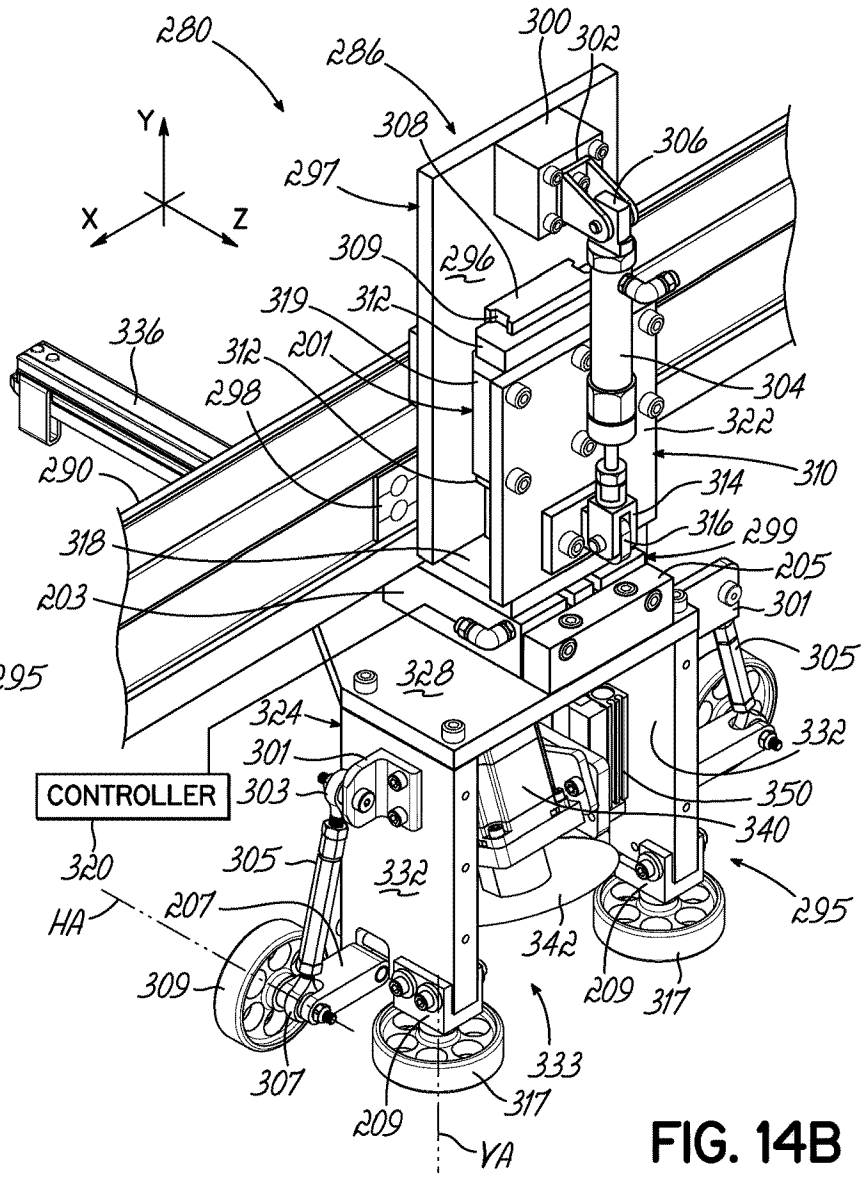
FIG. 14B is a front perspective view of the movable carriage of the automated stapler/cutter showing the head in its engaged position.
Figure 14A:
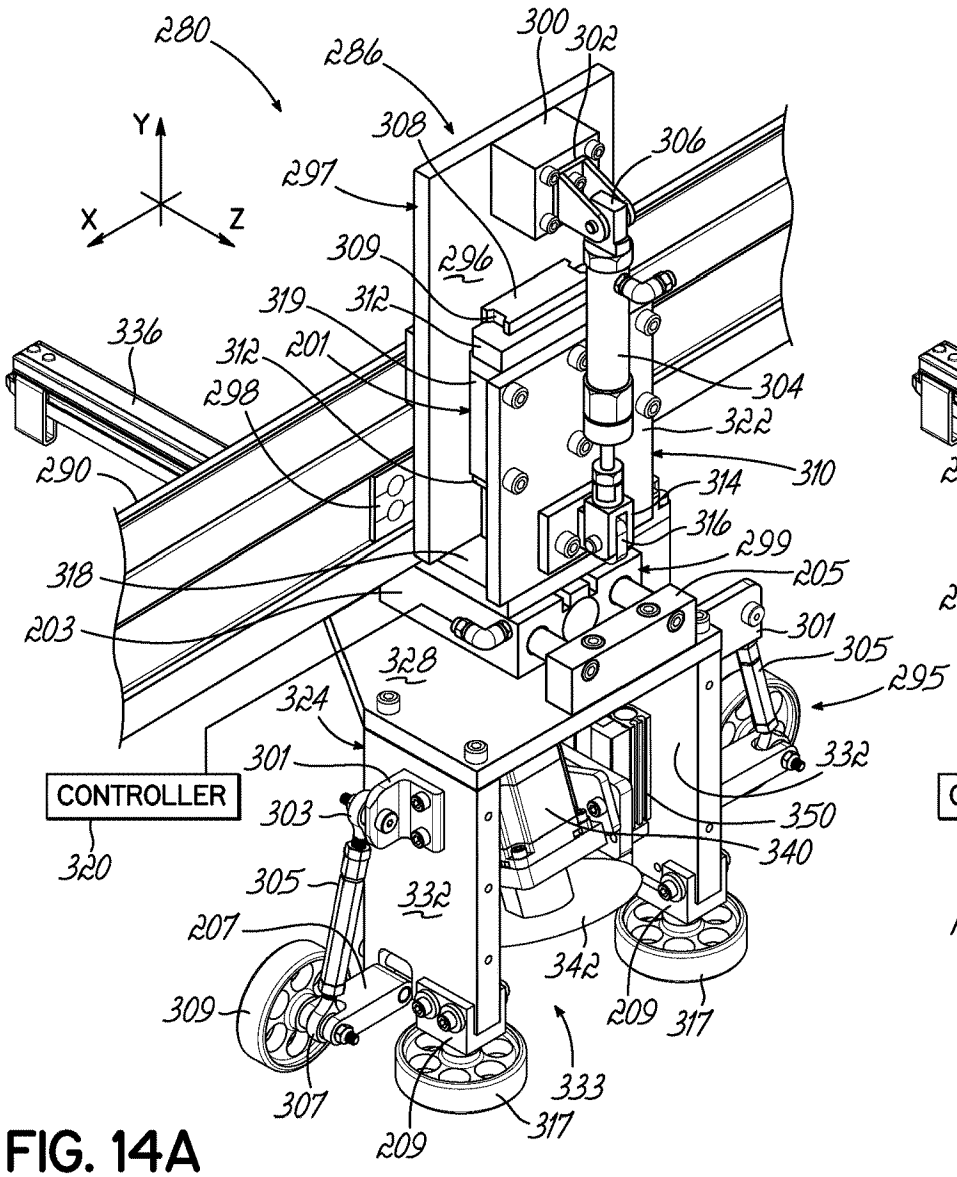
FIG. 14A is a front perspective view of the movable carriage of the automated stapler/cutter showing the head in its disengaged position.

The moveable carriage 286 includes three movable portions: 1) an upper portion 297 which moves in the direction of the x-axis by the linear actuator 290; 2) a sub-carriage 310 which moves in the direction of the y-axis relative to the upper portion 297 by an air cylinder 304 and 3) a head 295 which moves in the direction of the z-axis relative to the sub-carriage 310 by a thruster 299. As best shown in FIGS. 13A and 13B, the sub-carriage 310 moves between a raised position shown in FIG. 13A and a lowered position shown in FIG. 13B in the direction of the y-axis relative to the upper portion 297 of the moveable carriage 286 by the air cylinder 304. As best shown in FIGS. 14A and 14B, the head 295 moves between a disengaged position shown in FIG. 14A and an engaged position shown in FIG. 14B in the direction of the z-axis relative to the sub-carriage 310 by the thruster 299.

When the moveable carriage 286 is in its parked position off to one side of the truss, as shown in FIGS. 12A and 12B, the sub-carriage 310 is in its raised position shown in FIG. 13A and the head 295 is in its disengaged position shown in FIG. 14A. When the moveable carriage 286 is in its parked position with the sub-carriage 310 in its raised position and the head 295 in its disengaged position, the moveable carriage 286 does not interfere with the manual stapling or wrapping operations.

As best shown in FIGS. 13A and 13B, the upper portion 297 of the moveable carriage 286 includes a backing plate 296 secured to the movable plate 298 of linear actuator 290. The upper portion 297 of the moveable carriage 286 further includes a spacer 300 secured to an upper portion of the backing plate 296 and extending forwardly from the backing plate 286. A generally U-shaped mounting bracket 302 is secured to the spacer 300 and extends forwardly from the spacer 300. The upper portion 297 of the moveable carriage 286 further includes a rail 308 secured to the backing plate 296 below the spacer 300. As best shown in FIG. 13B, the rail 308 has grooves 309 on the sides thereof. The rail 308 does not move relative to the backing plate 296.

The sub-carriage 310 is movable in the direction of the y-axis relative to the upper portion 297 of the moveable carriage 286 via an air cylinder 304 regardless of the position of the upper portion 297 of the moveable carriage 286 in the direction of the x-axis. The timing of when the sub-carriage 310 moves in the direction of the y-axis is determined by a programmable logic controller 320 which operates the air cylinder 304. See FIGS. 13A and 13B. The distance the sub-carriage 310 moves in the direction of the y-axis is determined by the size of the truss. The sub-carriage 310 travels downward until the top wheels 309 of the sub-carriage 310 engage a covered upper surface 311 of a wrapped truss 282 See FIGS. 13A and 13B.

The sub-carriage 310 comprises an attachment plate 322 which moves with the sub-carriage 310. The sub-carriage 310 further comprises a linear bearing 201 including a mounting block 319 and upper and lower U-shaped guides 312. The mounting block 319 is secured to the attachment plate 322 inside the attachment plate 322. The upper and lower U-shaped guides 312 are secured to the mounting block 319 and all three elements 312, 319 travel together as the linear bearing 201 in the direction of the y-axis relative to the rail 308. End portions of the upper U-shaped guide 312 and end portions of the lower U-shaped guide 312 travel inside the grooves 309 of the rail 308 as the sub-carriage 310 moves in the direction of the y-axis and guide movement of the linear bearing 201 of the sub-carriage 310 in the direction of the y-axis relative to the rail 308. FIG. 13A shows the linear bearing 201 in a raised position relative to the rail 308 when the sub-carriage 310 is in its raised position. FIG. 13B shows the linear bearing 201 in a lowered position relative to the rail 308 when the sub-carriage 310 is in its lowered position.

The sub-carriage 310 further comprises a connecting plate 318 attached to the attachment plate 322 of the sub-carriage 310 and oriented generally perpendicular to the attachment plate 322.

As best shown in FIGS. 13A and 13B, the moveable carriage 286 further comprises an air cylinder 304 extending between the upper portion 297 of the moveable carriage 286 and the sub-carriage 310. The air cylinder 304 controls movement of the sub-carriage 310 in the direction of the y-axis relative to the upper portion 297 of the moveable carriage 286. The air cylinder 304 has an upper end 306 pivotally secured to the mounting bracket 302 of the upper portion 297 of the moveable carriage 286. The air cylinder 304 has a generally U-shaped lower end 314 pivotally secured to a T-shaped mounting bracket 316 secured to the attachment plate 322 of the sub-carriage 310. As shown in FIGS. 13A and 13B, the operation of the air cylinder 304 is controlled by the programmable logic controller 320.

The sub-carriage 310 further comprises a thruster 299 below the connecting plate 318. The main function of the thruster 299 is to move the head 295 relative to the sub-carriage 310 in the direction of the z-axis. The thruster 299 has a middle portion 203 connected to the connecting plate 318 which causes the head 295 to move in the direction of the y-axis along with the sub-carriage 310. The thruster 299 also has two end portions 205 (only one being shown) attached to the head 295 and more particularly, to a top plate 328 of a three-sided structure 324. This connection causes the head 295 to move in the direction of the z-axis relative to the sub-carriage 310 regardless of the position of the sub-carriage 310. The thruster 299 moves the head 295 in the direction of the z-axis relative to the sub-carriage 310 between a disengaged position shown in FIG. 14A and an engaged position shown in FIG. 14B. Any linear actuator may be used as thruster, but one which has proven satisfactory is an extruded linear thruster available at http://www.bimba.com/Products-and-Cad/Actuators/Inch/Guided/Standard-Load/Extruded-Linear-Thruster. As shown in FIGS. 14A and 14B, the operation of the thruster 299 is controlled by the programmable logic controller 320.

As best shown in FIGS. 13A and 13B, the sub-carriage 310 further comprises a three-sided structure 324 for protecting an operator from a rotating blade 342. The three-sided structure 324 includes a top plate 328, a front plate 330 and two side plates 332 defining an interior space 333. As shown in FIGS. 15A-15E, the rear of the three-sided structure 324 is open to allow access inside an interior 333 of the three-sided structure 324.

As best shown in FIGS. 15A-15E, a stapler 326 is attached to one of the side plates 332 of the three-sided structure 324. The stapler 326 is located outside the three-sided structure 324. The stapler 326 has a stapler body 334, a stapler head 335 below the stapler body 334 and a stapler magazine 336 extending rearwardly from the stapler body 334. Any known stapler may be used, but one which has proven satisfactory is a long magazine stapler available at the website http://www.beafastenersusa.com from BeA Fasteners USA Incorporated of Greensboro, N.C.

As best shown in FIG. 13B, a linear actuator 350 is attached to the same side plate 332 of the three-sided structure 324 as the stapler 326, but inside the side plate 332. It is within the scope of the present invention that the linear actuator 350 may be attached to a different side plate of the three-sided structure 324 than the stapler 326. The drawings are not intended to be limiting. The linear actuator 350 is located inside the interior space 333 of the three-sided structure 324. Any linear actuator may be used, but one which has proven satisfactory is identified as a Bimba twin bore linear actuator available at the website https://bimba-.com/Products-and-Cad/Actuators/Inch/Compact/Air-Table-Slide/Twin-Bore-Air-Table. As shown in the drawings, the linear actuator 350 is operated by the programmable logic controller 320.

A cutter 338 is attached to the linear actuator 350 and moved by linear actuator 350. The cutter 338 comprises a servo motor 340, a rotatable blade 342 and a fabric lifter 344. The linear actuator 350 is attached to a servo motor 340 to move the servo motor 340 between a raised position and a lower position in the direction of the y-axis by the programmable logic controller 320 as described herein inside the three-sided structure 324.

A rotatable blade 342 is located below the servo motor 340 and powered by the servo motor 340. As best illustrated in FIGS. 15A-15E, the cutter 338 further comprises a fabric lifter 344 mounted to the servo motor 340 for lifting the fabric web 14 before it is cut by the rotatable blade 342 on the carriage's second or return pass over the partially finished truss 288.

As best illustrated in FIGS. 13A and 13B, an upper mounting bracket 301 is secured to each side plate 332 of the three-sided structure 324 of the head 295 of the moveable carriage 286. An upper end 303 of a turn buckle 305 is pivotally secured to the upper mounting bracket 301. A lower mounting bracket 207 is secured to each side plate 332 of the three-sided structure 324 of the head 295 of the moveable carriage 286. A lower end 307 of each turn buckle 305 is pivotally secured to one of the two lower mounting brackets 207. A rotatable first or top wheel 309 rotatable about a horizontal axis HA is rotatably secured to one of the lower mounting brackets 207. The turn buckle's length is manually set. As shown in FIGS. 15A-15E, each rotatable first or top wheel 309 is adapted to engage a covered upper surface 311 of a wrapped truss 282.

As best illustrated in FIGS. 13A and 13B, an end mounting bracket 209 is secured to each side plate 332 of the three-sided structure 324 of the head 295 of the moveable carriage 286. A rotatable second or side wheel 317 rotatable about a vertical axis VA is secured to each end mounting bracket 209. As shown in FIGS. 15A-15E, each rotatable second or side wheel 317 is adapted to engage a covered side surface 321 of a wrapped truss 282.

Thus, the sub-carriage 310 has two top wheels 309 spaced from each other adapted to engage the covered upper surface 311 of an initially stapled truss 313. The sub-carriage 310 also has two side wheels 317 spaced from each other adapted to engage a covered side surface 321 of a wrapped truss 282. The rotatable top wheels 309 and rotatable side wheels 317 may be made of any desirable material including nylon.

Figure 15A:
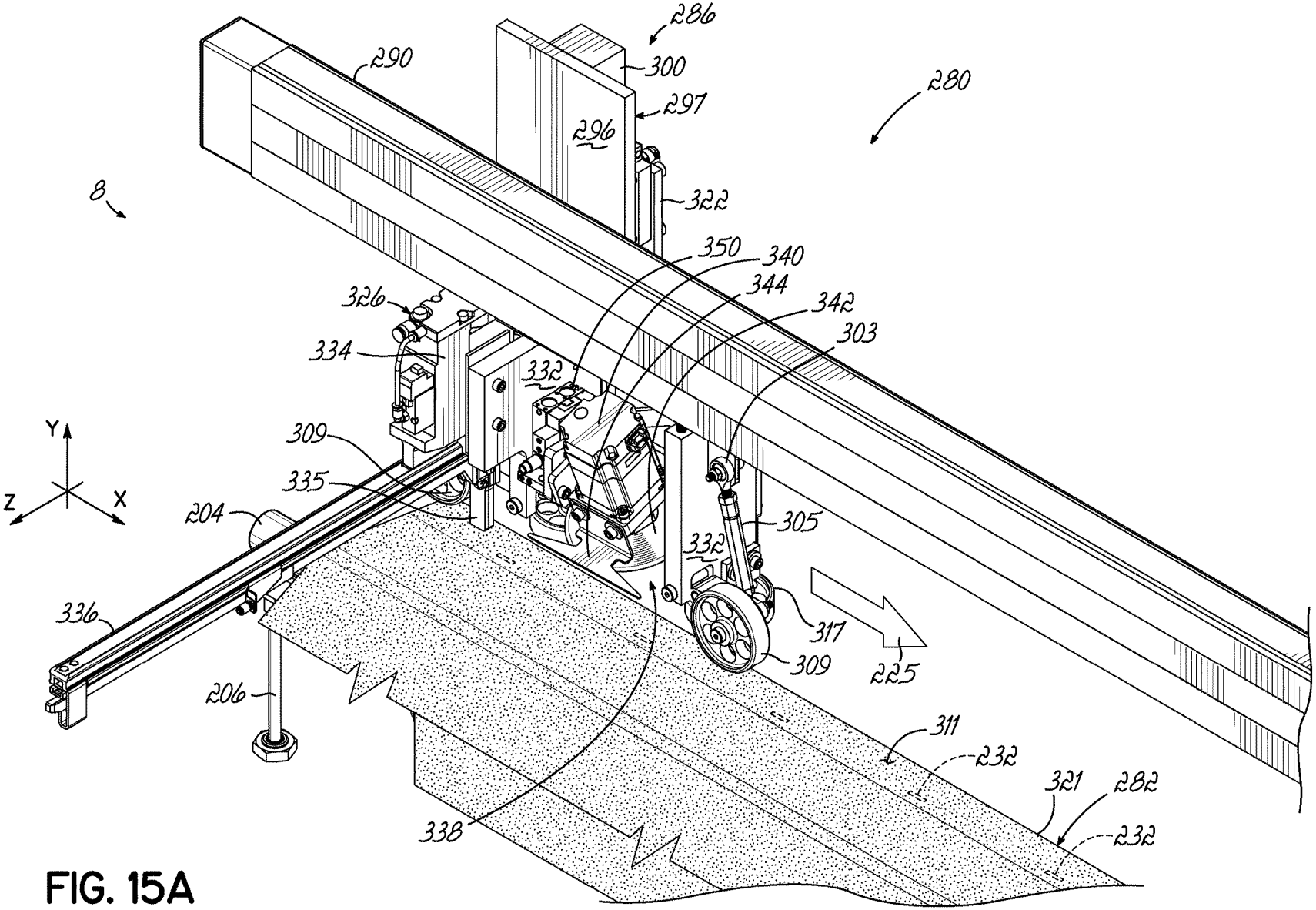
FIG. 15A is a rear perspective view of the movable carriage of the automated stapler/cutter moving from the right side to the left side of a wrapped truss and stapling at predetermined positions along the way.
Figure 15B:
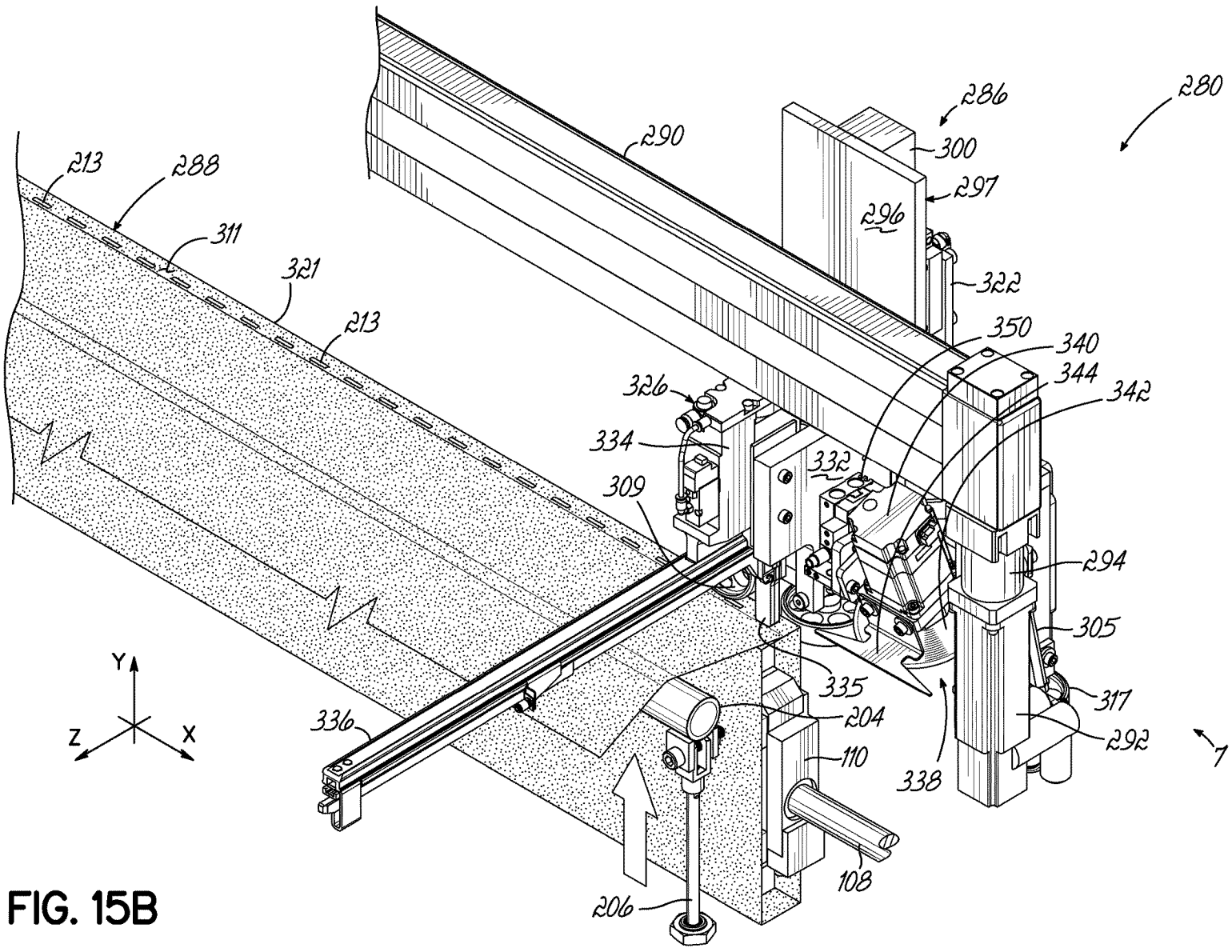
FIG. 15B is a rear perspective view of the movable carriage of the automated stapler/cutter after the last staple has been inserted in the last staple position at its left end position, the non-rotatable lifter bar being raised by pneumatic pistons of lifters (only one being shown).
Figure 15C:
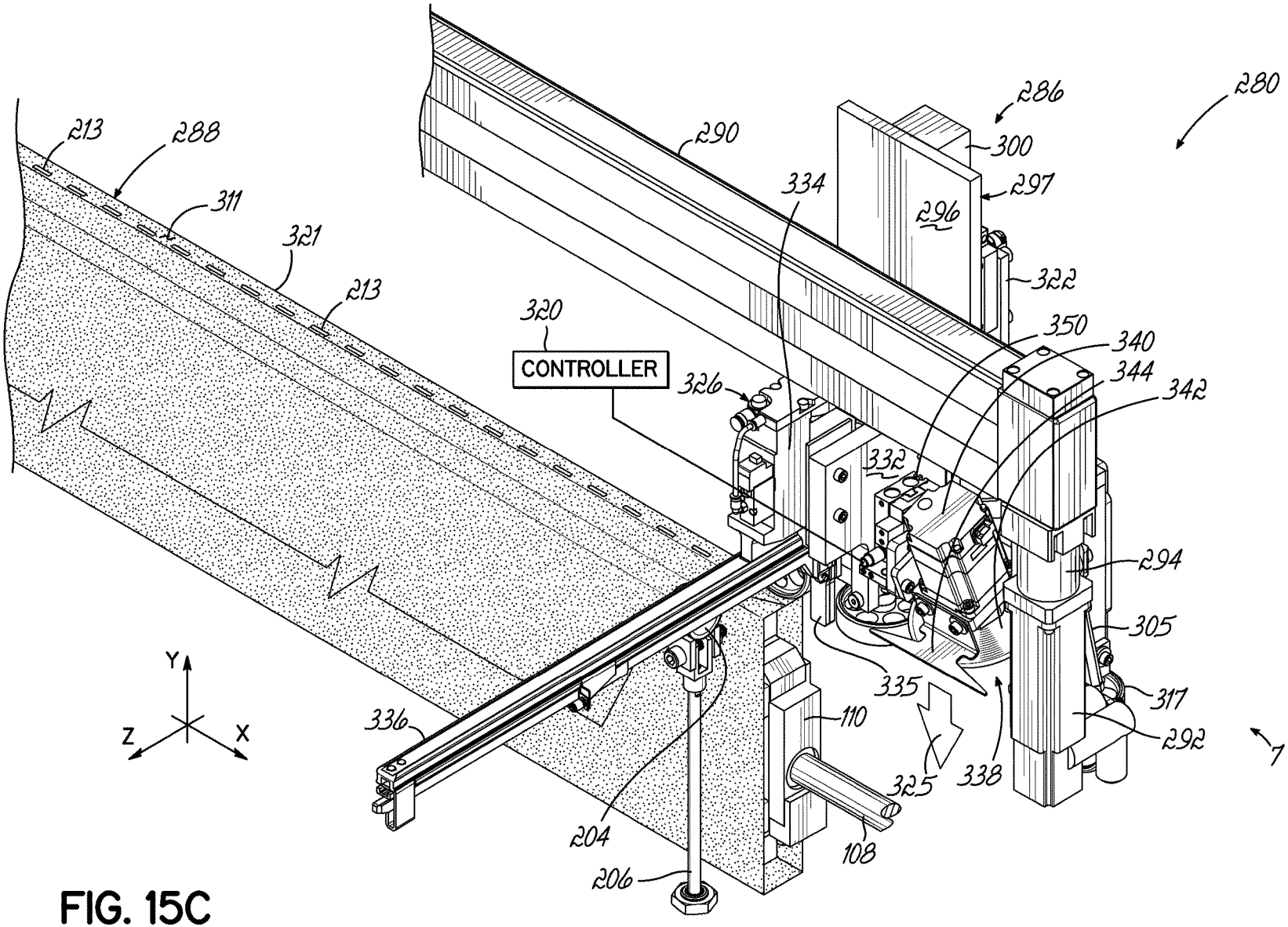
FIG. 15C is a rear perspective view of the movable carriage of the automated stapler/cutter at its start cutter position, the non-rotatable lifter bar being in its fully raised position and the cutter being lowered by a linear actuator.
Figure 15D:
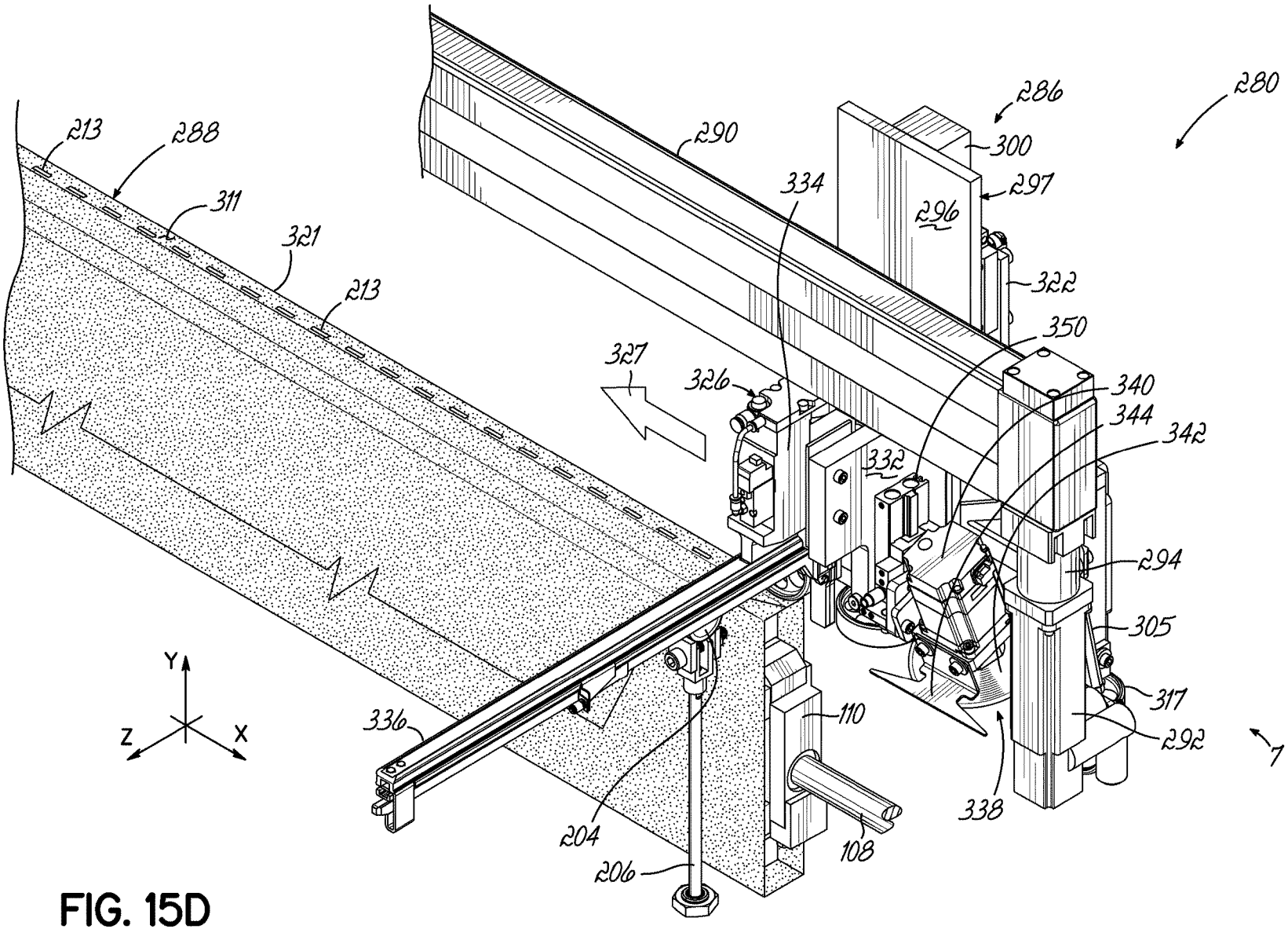
FIG. 15D is a rear perspective view of the movable carriage of the automated stapler/cutter in a cutter start position beginning to move back towards its original position, the non-rotatable lifter bar being in its fully raised position and the cutter's servo motor in its lower position.
Figure 15E:
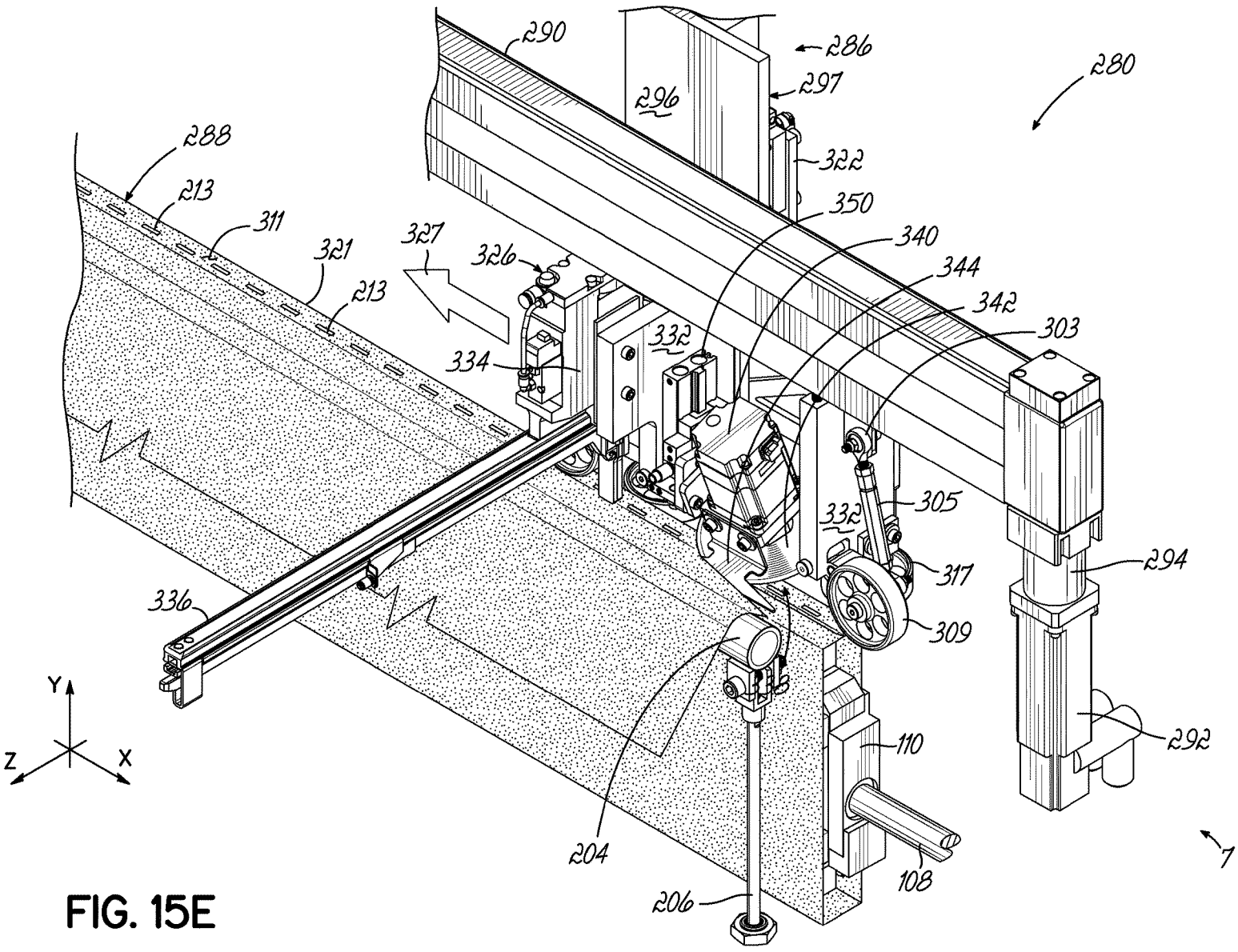
FIG. 15E is a rear perspective view of the movable carriage of the automated stapler/cutter moving back towards a cutter end position, the non-rotatable lifter bar being in its fully raised position and the rotatable blade cutting the fabric.

FIGS. 15A-15G illustrate the method of use of the automated stapler/cutter 280 in apparatus 10*a*. FIG. 15A illustrates a rear perspective view of the moveable carriage 286 with the stapling head 335 of the stapler 326 in a first stapling position. In order to get the moveable carriage 286 into this first stapling position, the programmable logic controller 320 instructs the linear actuator 290 to move the movable carriage 286 from its parked position shown in FIGS. 15G, 12A and 12B towards the other side of the apparatus 10*a* in the direction of the x-axis until the moveable carriage 286 is in its first stapling position. The programmable logic controller 320 further instructs the air cylinder 304 to move the sub-carriage 310 from its raised position shown in FIG. 13A to its lowered position shown in FIG. 13B. The programmable logic controller 320 further instructs the thruster 299 to move the head 295 from its disengaged position shown in FIG. 14A to its engaged position shown in FIG. 14B. Thus, after the moveable carriage 286 moves in the direction of the x-axis from its parked position shown in FIG. 15G to its first stapling position shown in FIG. 15A, the sub-carriage 310 of the moveable carriage 286 moves from its raised position shown in FIG. 13A to its lowered position shown in FIG. 13B in the direction of the y-axis and the head 295 the moveable carriage 286 moves from its disengaged position shown in FIG. 14A to its engaged position shown in FIG. 14B in the direction of the z-axis.

As shown in FIG. 15A, when the moveable carriage 286 is in its first stapling position and the sub-carriage 310 in its lowered position and the head 295 in its engaged position, the moveable carriage 286 is ready to perform a stapling operation as the moveable carriage 286 moves from the right side 8 towards the left side 7 of the apparatus 10*a* above a wrapped truss 282, as shown by arrow 225 in FIG. 15A. An operator has already manually stapled the fabric web 14 to the upper surface 246 of the upper member 16 of the truss 12 with staples 232 to create an initially stapled truss 313, as shown in FIG. 12A. The initially stapled truss 313 has been wrapped to create the wrapped truss 282 shown in FIG. 15A. With the moveable carriage 286 in its first staple position above the wrapped truss 282, the moveable carriage 286 makes its first staple in a precalculated first staple position determined by the programmable logic controller 320. The moveable carriage 286, and more particularly the stapler 326 of the moveable carriage 286 makes additional staples 213 at evenly spaced positions between the precalculated first and last staple positions, as calculated by the programmable logic controller 320. See FIG. 15B.

FIG. 15B illustrates the stapler 326 of the moveable carriage 286 making its last staple in the last staple position. After all staples 213 have been inserted into the wrapped truss 282, the moveable carriage 286 is moved further along in the direction of the x-axis to its cutter start position shown in FIG. 15C. While the moveable carriage 286 is the cutter start position shown in FIG. 15C, pneumatic pistons 206 (only one being shown lift the non-rotatable lifter bar 204 to its raised position to lift up the fabric web 14. FIG. 15C illustrates the cutter 338, including the servo motor 340 and rotatable blade 342 of the head 295 of the moveable carriage 286 being lowered to a lower position from its raised position via the linear actuator 350 in the direction of arrow 325 as instructed by the programmable logic controller 320 when the moveable carriage 286 is the cutter start position shown in FIG. 15C.

As shown in FIG. 15D, with the cutter 338 in its lowered position and the moveable carriage 286 in its cutter start position, the programmable logic controller 320 then instructs the linear actuator 290 to move the moveable carriage 286 in the opposition direction in the direction of the x-axis back towards the moveable carriage's first staple position in the direction of arrow 327 (from the left side 7 towards the right side 8 of the apparatus 10*a*).

FIG. 15E illustrates the moveable carriage 286 moving in the same direction as shown in FIG. 15D in the direction of arrow 327 (from the left side 7 towards the right side 8 of the apparatus 10*a*) with the sub-carriage 310 of the moveable carriage 286 in its lower position and the head 295 of the moveable carriage 286 in its engaged position. With the sub-carriage 310 in its lower position and the head 295 in its engaged position, the fabric lifter 344 of the cutter 338 raises the fabric web 14 so that the rotating blade 342 of the head 295 cuts the fabric web 14 underneath the fabric lifter 344 as the moveable carriage 286 moves back towards its original starting position in the direction of arrow 327 in the direction of the x-axis.

Figure 15F:
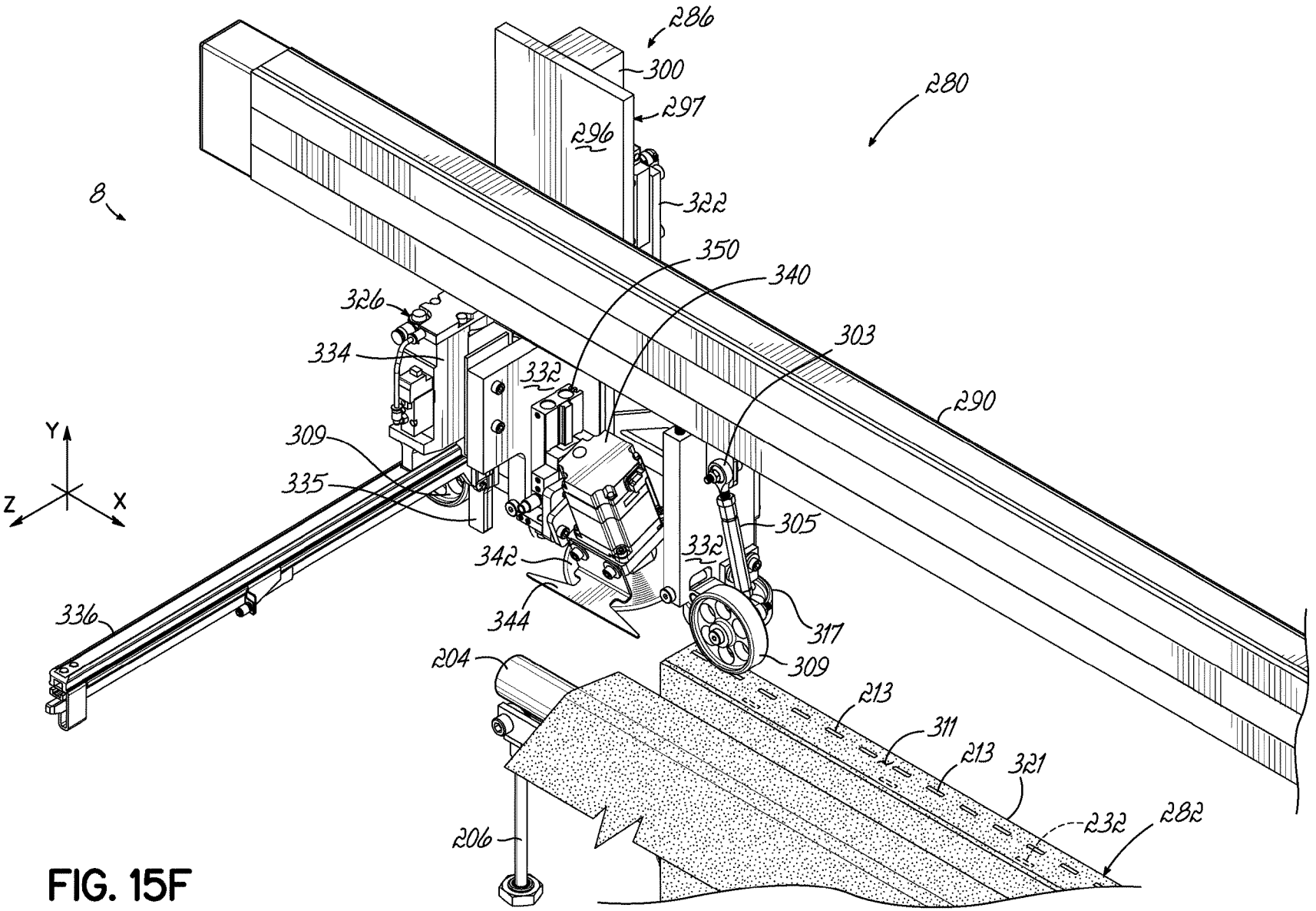
FIG. 15F is a rear perspective view of the movable carriage of the automated stapler/cutter in its cutter end position, the non-rotatable lifter bar being in its fully raised position and the fabric being fully cut.

FIG. 15F illustrates the moveable carriage 286 in its cutter end position, the rotating blade 342 of the head 295 having completed its cut across the width of the fabric web 14 underneath the fabric lifter 344.

Figure 15G:
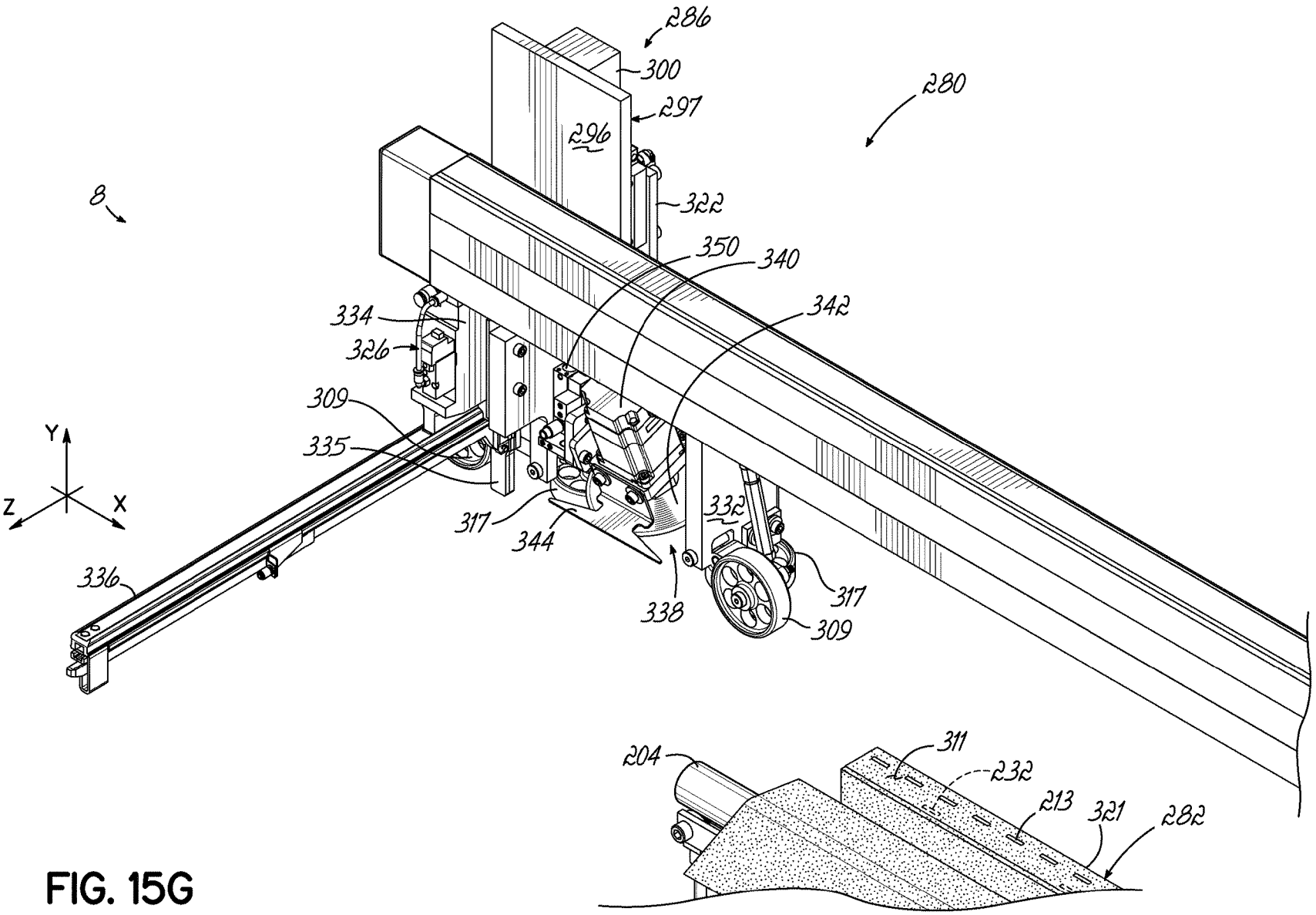
FIG. 15G is a rear perspective view of the movable carriage of the automated stapler/cutter in its parked position.

FIG. 15G illustrates the moveable carriage 286 in its parked position. For the moveable carriage 286 to move to its parked position shown in FIG. 15G from its cutter end position shown in FIG. 15G, the linear actuator 290 moves the moveable carriage 286 further along the x-axis in the direction it had been traveling while cutting (right to left in the drawings). In addition, the linear actuator 350 raises the cutter 338 including the servo motor 340 and rotatable blade 342 as instructed by the programmable logic controller 320. Further, the programmable logic controller 320 operates to move the sub-carriage 310 from its lowered position to its raised position and move the head 295 from its engaged position to its disengaged position.

After the moveable carriage 286 is back in its original starting or parked position, the fabric web 14 cut along the full length of the wrapped truss 282 and the stapling of the fabric web 14 over the covered upper surface 311 of the wrapped truss 282 completed at positions determined by the programmable logic controller 320 to create two layers of fabric along one surface 311 of the partially finished truss 288, the partially finished truss 288 is removed from the apparatus 10*a*. The partially finished truss 288 is like the partially finished truss 256 shown in FIG. 11A with open ends. As shown in FIGS. 11A-11E, the open ends of the partially finished truss 288 are closed and stapled shut as described herein. However, any known method of closing the open ends of the partially finished truss 288 may used to close the ends. The method of stapling described herein is not intended to be limiting.

Figure 16:
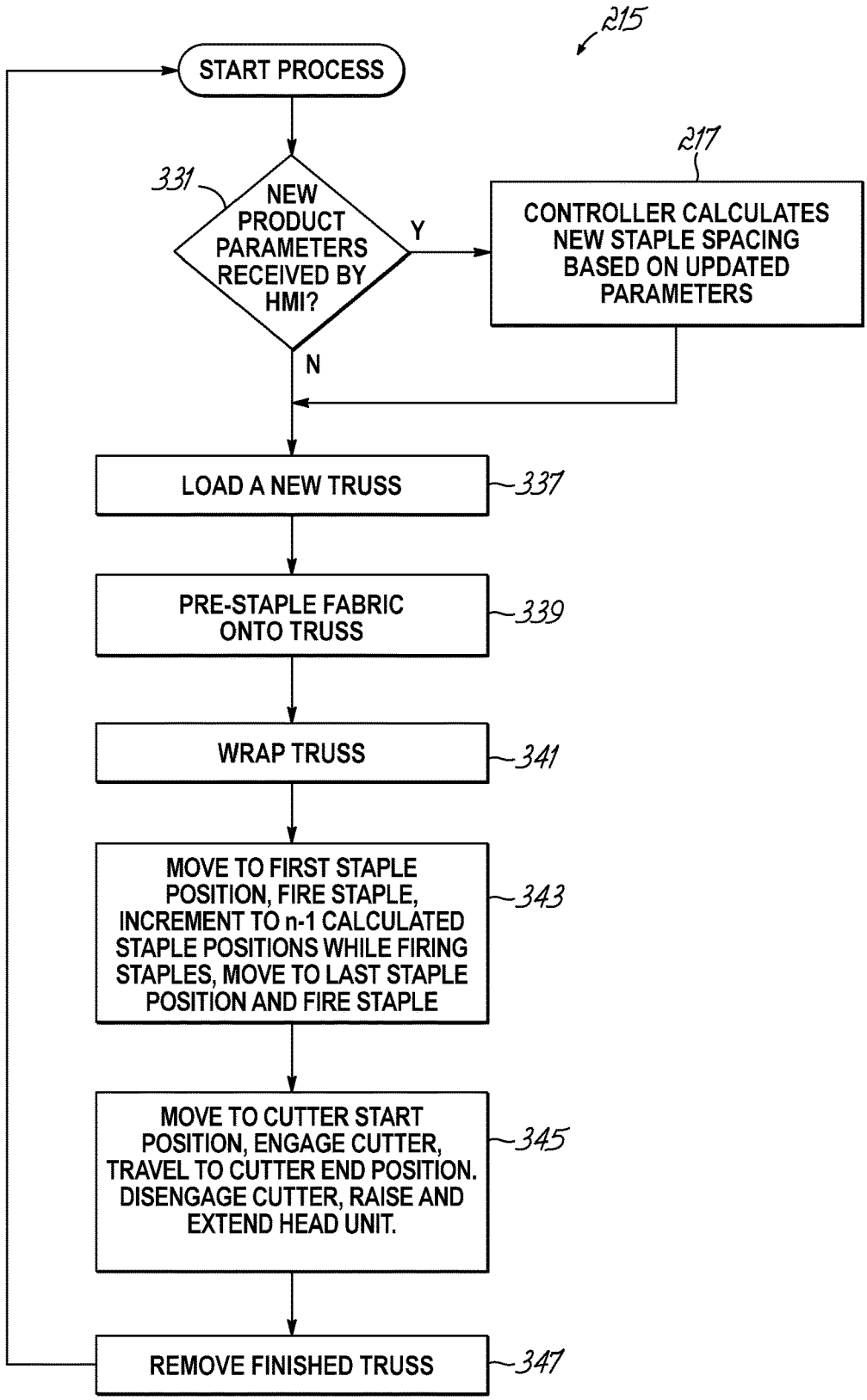
FIG. 16 is a flowchart of the operation of the apparatus having the automated stapler/cutter shown in FIGS. 12A-15E.

FIG. 16 illustrates a flowchart 215 showing the operation of the apparatus 10*a*. As indicated in diamond 331, the first question is whether the Human Machine Interface ("HMI") or control panel 214 has received new product parameters from the operator. If not, the operator loads in a new truss 12, as indicated by block 337.

On the other hand, if the HMI or control panel 214 has received new product parameters from the operator when the size of truss is different then the programmable logic controller 320 calculates new staple spacing, as indicated in block 217 based on the updated product parameters. Such parameters include a new first staple position, a last staple position, a cutter start position, a cutter end position and a staple ready position entered by an operator. Based on the newly entered positions, the programmable logic controller 320 calculates new staple spacing based on the updated parameters.

As shown by block 339, the operator then manually staples the fabric web 14 to the upper member 16 of a truss 12 with staples 223, the front edge of the fabric web 14 aligning with the front edge of the upper member 16 of the truss 12 as shown in FIG. 12A. As shown by block 341, the left and right vise mechanisms 106, 114, respectively, rotate the initially stapled truss 313 to create a wrapped truss 282.

As indicated by block 343, after the truss is wrapped, the moveable carriage 286 moves in the direction of the x-axis from its parked position to its first staple position as determined by the programmable logic controller 320. The sub-carriage 310 then moves from its raised position to its lowered position and the head 295 moves from its disengaged position to its engaged position as determined by the programmable logic controller 320. The moveable carriage 286 is considered to be in a staple ready position when the sub-carriage 310 is in its lowered position and the head 295 is in its engaged position.

The stapler 326 of the moveable carriage 286 then fires its first staple. As the moveable carriage 286 moves from side-to-side above the wrapped truss 282, the stapler 326 staples the fabric web 14 over the covered upper surface 311 at positions determined by the programmable logic controller 320 to create two layers of fabric along one surface of the wrapped truss 282. When the moveable carriage 286 is in its last staple position as determined by the programmable logic controller 320, the stapler 326 of the moveable carriage 286 then fires its last staple in the last staple position.

As indicated by block 345, after the truss is fully stapled, the linear actuator 290 moves the moveable carriage 286 further along the x-axis in the direction it had been traveling while stapling (right to left in the drawings) until the moveable carriage 286 is in a cutter start position. While the sub-carriage 310 is in its lowered position and the head 295 is in its engaged position and the cutter 338 is engaged or operating, i.e. the rotatable blade 342 is rotating by the servo-motor 340, the moveable carriage 286 travels from its cutter start position towards the cutter end position. Once the moveable carriage 286 is back in its cutter end position and the fabric web 14 fully cut, the programmable logic controller 320 operates to move the moveable carriage 286 to its parked position with the sub-carriage 310 in its raised position and the head 295 in its disengaged position. As indicated by block 347, the operator then removes the finished truss 284 and the process starts over.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A method of wrapping fabric around a truss for a bedding foundation, the method comprising:

providing a roll of fabric supported by a fabric support;

providing a wrapping apparatus comprising two sides and braces extending between the sides, a truss holder movable between raised and lowered positions by pneumatically controlled cylinders secured to a front brace, a first vise mechanism secured to one side of the apparatus, a second vise mechanism secured to another side of the apparatus and a rotatable tension roller surrounding a shaft, the shaft extending between bearing assemblies attached to the sides of the apparatus;

passing fabric from the roll of fabric through the wrapping apparatus;

activating one of the vise mechanisms to move the vise mechanism in a linear direction towards the other vise mechanism to pinch the truss between the vise mechanisms;

stapling the fabric to an upper surface of the truss to create an initially stapled truss;

moving the truss holder to its lowered position;

rotating the initially stapled truss with the vise mechanisms to create a wrapped truss;

moving a carriage in a first direction over the wrapped truss with a linear actuator, a stapler secured to the carriage further stapling the fabric to the wrapped truss; and moving the carriage in a second direction opposite the first direction over the wrapped truss to cut the fabric to create a finished truss.

2. The method of claim 1, further comprising separating the vise mechanisms to remove the finished truss from between the vise mechanisms, moving the truss holder to its raised position and resetting the vise mechanisms.

3. The method of claim 1, wherein passing fabric from the roll of fabric through the wrapping apparatus comprises passing the fabric between an idle roller and a rotatable tension roller surrounding a shaft, the shaft extending between bearing assemblies attached to the sides of the apparatus.

4. The method of claim 1, wherein rotating the truss with the vise mechanisms comprises rotating the truss at least one full rotation.

5. The method of claim 4, further comprising using a mechanism to advance the fabric extending through the apparatus.

6. The method of claim 4, wherein passing fabric from the roll of fabric through the wrapping apparatus comprises passing the fabric around at least one idle roller.

7. A method of wrapping fabric around a truss for a bedding foundation, the method comprising:

providing a roll of fabric supported by a fabric support;

providing a wrapping apparatus comprising two sides and braces extending between the sides, a truss holder movable between raised and lowered positions, a first vise mechanism secured to one side of the apparatus, a second vise mechanism secured to another side of the apparatus and a rotatable tension roller surrounding a shaft, the shaft extending between bearing assemblies attached to the sides of the apparatus;

passing fabric from the roll of fabric through the wrapping apparatus;

activating one of the vise mechanisms to move the vise mechanism in a linear direction towards the other vise mechanism to pinch the truss between the vise mechanisms;

stapling the fabric to the truss to create an initially stapled truss;

moving the truss holder to its lowered position;

rotating the initially stapled truss with the vise mechanisms to create a wrapped truss;

moving a carriage in a first direction over the wrapped truss with a linear actuator, a stapler secured to the carriage further stapling the fabric to the wrapped truss; and cutting the fabric to create a finished truss.

8. The method of claim 7, further comprising separating the vise mechanisms to remove the finished truss from between the vise mechanisms, moving the truss holder to its raised position and resetting the vise mechanisms.

9. The method of claim 7, wherein passing fabric from the roll of fabric through the wrapping apparatus comprises passing the fabric between an idle roller and a rotatable tension roller surrounding a shaft, the shaft extending between bearing assemblies attached to the sides of the apparatus.

10. The method of claim 7, wherein rotating the truss with the vise mechanisms comprises rotating the truss at least one full rotation.

11. The method of claim 7, further comprising using a mechanism to advance the fabric extending through the apparatus.

12. The method of claim 7, wherein passing fabric from the roll of fabric through the wrapping apparatus comprises passing the fabric around at least one idle roller.

13. The method of claim 7, wherein the truss holder is movable between raised and lowered positions by pneumatically controlled cylinders.

14. A method of wrapping fabric around a truss for a bedding foundation, the method comprising:

passing fabric from a roll of fabric supported by a fabric support through a wrapping apparatus, the wrapping apparatus comprising a truss holder movable between raised and lowered positions, a first vise mechanism secured to one side of the apparatus, a second vise mechanism secured to another side of the apparatus and a rotatable tension roller surrounding a shaft, the shaft extending between bearing assemblies attached to the sides of the apparatus;

activating one of the vise mechanisms to move the vise mechanism in a linear direction towards the other vise mechanism to pinch the truss between the vise mechanisms;

stapling the fabric to an upper surface of the truss to create an initially stapled truss;

moving the truss holder to its lowered position;

rotating the initially stapled truss with the vise mechanisms to create a wrapped truss;

moving a carriage in a first direction over the wrapped truss with a linear actuator, a stapler secured to the carriage further stapling the fabric to the wrapped truss; and cutting the fabric to create a finished truss.

15. The method of claim 14, further comprising separating the vise mechanisms to remove the finished truss from between the vise mechanisms, moving the truss holder to its raised position and resetting the vise mechanisms.

16. The method of claim 14, wherein passing fabric from the roll of fabric through the wrapping apparatus comprises passing the fabric between an idle roller and a rotatable tension roller surrounding a shaft, the shaft extending between bearing assemblies attached to the sides of the apparatus.

17. The method of claim 14, wherein rotating the truss with the vise mechanisms comprises rotating the truss at least one full rotation.

18. The method of claim 14, further comprising using a mechanism to advance the fabric extending through the apparatus.

19. The method of claim 14, wherein passing fabric from the roll of fabric through the wrapping apparatus comprises passing the fabric around at least one idle roller.

20. The method of claim 14, wherein the truss holder is movable between raised and lowered positions by pneumatically controlled cylinders.

* * * * *